US005145499A

United States Patent [19]

Dyson

[11] Patent Number: 5,145,499

[45] Date of Patent: Sep. 8, 1992

[54] DISPOSABLE BIN FOR CYCLONIC VACUUM

[75] Inventor: James Dyson, Bath-Avon, England

[73] Assignee: Notetry Limited, Bristol, England

[21] Appl. No.: 838,860

[22] Filed: Feb. 21, 1992

Related U.S. Application Data

[63] Continuation-in-part of Ser. No. 585,975, Sep. 21, 1990, Pat. No. 5,090,976.

[51] Int. Cl.[5] ..... B01D 45/12

[52] U.S. Cl. ..... 55/337; 55/345; 55/429; 55/459.1; 55/DIG. 2; 55/DIG. 3

[58] Field of Search ..... 15/353; 55/337, 345, 55/429, 432, 459.1, 459.2, DIG. 2, DIG. 3

[56] References Cited

U.S. PATENT DOCUMENTS

| | | | |
|---|---|---|---|
| 4,571,772 | 2/1986 | Dyson | 15/335 |
| 4,573,323 | 2/1986 | Dyson | 15/333 |
| 4,593,429 | 6/1986 | Dyson | 15/353 |
| 4,643,748 | 2/1987 | Dyson | 55/338 |
| 4,826,515 | 5/1989 | Dyson | 55/345 |
| 4,853,008 | 8/1989 | Dyson | 55/345 |
| 4,853,011 | 8/1989 | Dyson | 55/345 |
| 5,062,870 | 11/1991 | Dyson | 55/213 |
| 5,078,761 | 1/1992 | Dyson | 55/213 |

*Primary Examiner*—Charles Hart
*Attorney, Agent, or Firm*—Ian C. McLeod

[57] ABSTRACT

A unitary liner (36) for use in a dual inner and outer cyclonic vacuum cleaning apparatus (10) is described. The liner has a rigid receiver member (38) that collects dirt separated from the airflow by the inner cyclone (12). The receiver is integrally bonded to a flexible container portion (37) that lays over the inner surface (11D) of the outer cyclone (11) to collect dirt separated from the airflow by the outer cyclone. The container portion (41) can also be a rigid member bonded to a rigid receiver (42). Also, the rigid container portion (45) can provide the outer cyclone and be bonded to a rigid receiver (46). The liner collects separated dirt from the inner and outer cyclones and is easy to remove and replace from the cleaning apparatus by removing the cover (13) which supports the inner cyclone, from the outer cyclone to expose the liner when the vacuum cleaner becomes full of dirt. A liner (130) for a tank type, dual inner and outer cyclonic vacuum cleaning apparatus (110) is also described. The tank type liner has a rigid receiver member (131), which collects dirt separated from the airflow by inner cyclone (112) and an integrally bonded flexible container portion (132) that lays over the inside of the outer cyclone (111) to collect dirt separated from the airflow by the outer cyclone. A liner cage (113) with projection finger (113A) extends between the inner cyclone (112) and the base (111A) of the outer cyclone. The projection fingers hold the flexible container portion on the base of the outer cyclone to prevent the liner from moving towards and blocking dirt separated from the airflow by the inner cyclone from being deposited in the receiver. The liner is easy to remove and replace in the tank type cleaning apparatus by separating a cover (115), which supports the inner cyclone, from the outer cyclone to expose the liner when the vacuum cleaner becomes full of dirt.

57 Claims, 10 Drawing Sheets

Figure 1:
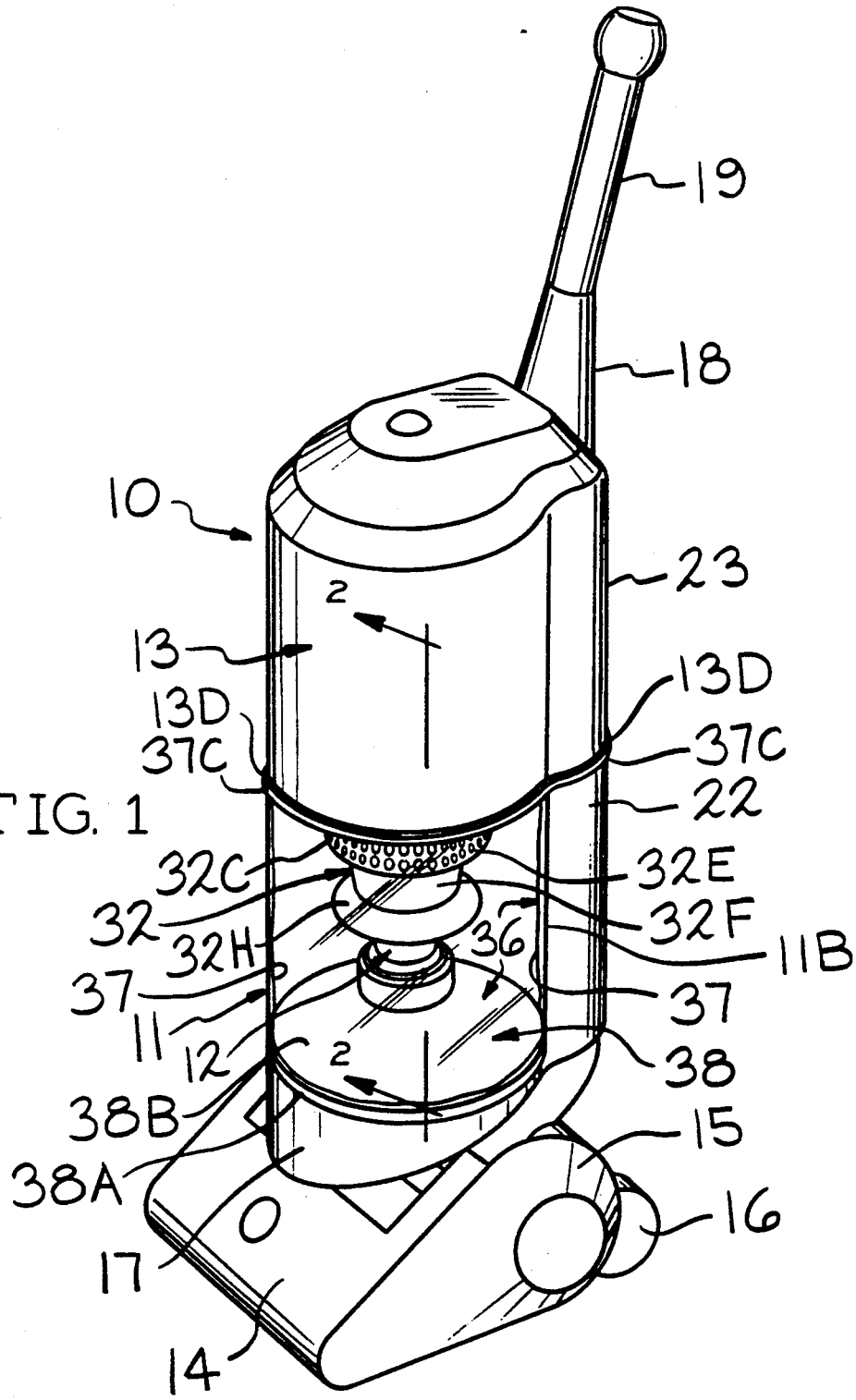

110
115
115A
115B
115C
115D
115E
115F
115G
115H
115I
115J
C
137
136
134
133
135
132C
111I
117
119
114
118
116
116A
116B
120B
120
121
132D
12
13
14
122
123
124
125
125A
126
127
128
128A
120A
111F
129
129A
129B
129C
129D
129E
131C
131D
113A
113B
113D
112D
111
111E
132
113
112A
112C
112
112B
131
131B
130
111D
111C
111B
132A
111A
111H
111G

DISPOSABLE BIN FOR CYCLONIC VACUUM

CROSS-REFERENCE TO RELATED APPLICATION

This application is a continuation-in-part of my application Ser. No. 07/585,975, filed Sept. 21, 1990 and now U.S. Pat. No. 5,090,976.

BACKGROUND OF THE INVENTION

1. Field of the Invention

The present invention relates to a disposable liner for a vacuum cleaner with a dual inner and outer cyclones. In particular, the present invention relates to a liner that fits inside of the outer cyclone so that dirt separated from the airflow in both the inner and the outer cyclones is deposited in the liner. The liner is a unitary member preferably having a flexible container portion that lays over the inside of the outer cyclone. The container portion is bonded to a rigid receiver portion that seals with the inner cyclone and collects dirt from a cone opening through which separated dirt from the inner cyclone is deposited into the receiver portion. In this manner, when the cyclones become full of dirt and the vacuum cleaner is ready to be emptied, the operator can easily separate the inner cyclone from the outer cyclone, lift the liner out of the outer cyclone, replace a new liner and after positioning the inner cyclone in place, resume vacuuming. Finger projections can also be provided intermediate the seal between the receiver portion of the liner and the inner cyclone, and the cone opening, which extend from the outside wall of the cyclone to the base of the outer cyclone. The projections hold the flexible container portion on the base of the receiver so that the container portion of the liner is prevented from moving towards the cone opening to block the cone opening. In another embodiment, the container portion of the liner is a rigid disposable member bonded to the rigid receiver member. The rigid container portion can also provide the outer cyclone and can be bonded to the receiver portion as a disposable unit.

2. Prior Art

My U.S. Pat. No. 4,593,429 makes reference to a disposable liner provided for the low efficiency cyclone or outer cyclone. Cyclonic vacuum cleaning apparatus are shown in my U.S. Pat. Nos. 5,062,870; 5,078,761 and in U.S. patent application Ser. No. 07/585,975, filed Sept. 21, 1990. Further, cyclonic vacuum cleaning apparatus are shown in my U.S. Pat. Nos. 4,573,236; 4,593,429; 4,571,772; 4,643,748; 4,826,515; 4,853,011 and 4,853,008.

OBJECTS

It is therefore an object of the present invention to provide a disposable liner which collects dirt separated from an airflow by a dual inner and outer cyclonic vacuum cleaning apparatus. Further, it is an object of the present invention to provide a disposable liner which mounts between the cyclones in a cyclonic vacuum cleaner having dual inner and outer cyclones. Still further, it is an object of the present invention to provide a disposable liner for a dual inner and outer cyclonic vacuum cleaning apparatus which has a flexible container portion laying over the inside of the outer cyclone and an integrally bonded, rigid receiver portion which collects dirt separated from the airflow by the inner cyclone. Furthermore, it is an object of the present invention to provide a disposable liner for a dual inner and outer cyclonic vacuum cleaning apparatus which has a rigid container portion laying over the inside of the outer cyclone and that is integrally bonded to a rigid receiver portion of the liner which collects dirt separated from the airflow by the inner cyclone. Still further, it is an object of the present invention to provide a disposable liner for a dual inner and outer cyclonic vacuum cleaning apparatus that has a rigid container portion providing the outer cyclone and an integrally bonded, rigid receiver portion which collects dirt separated from the airflow by the inner cyclone. Finally, it is an object of the present invention to provide a disposable liner for a dual inner and outer cyclonic vacuum cleaning apparatus which is made of a transparent material so that an operator can visually see when the cleaning apparatus is full of separated dirt and which is inexpensive to manufacture. These and other objects will become increasingly apparent by reference to the following descriptions and to the drawings.

IN THE DRAWINGS

FIG. 1 is a left side perspective view of a preferred upright type vacuum cleaning apparatus 10 of the present invention, particularly showing an outer cyclone 11 surrounding a combined shroud and disc unit 32 mounted on the outside of an inner cyclone 12 and with a disposable liner 36 providing a rigid receiver portion 38 for the inner cyclone 12 and a flexible container portion 37 laying over the inside of the outer cyclone 11.

Figure 2:
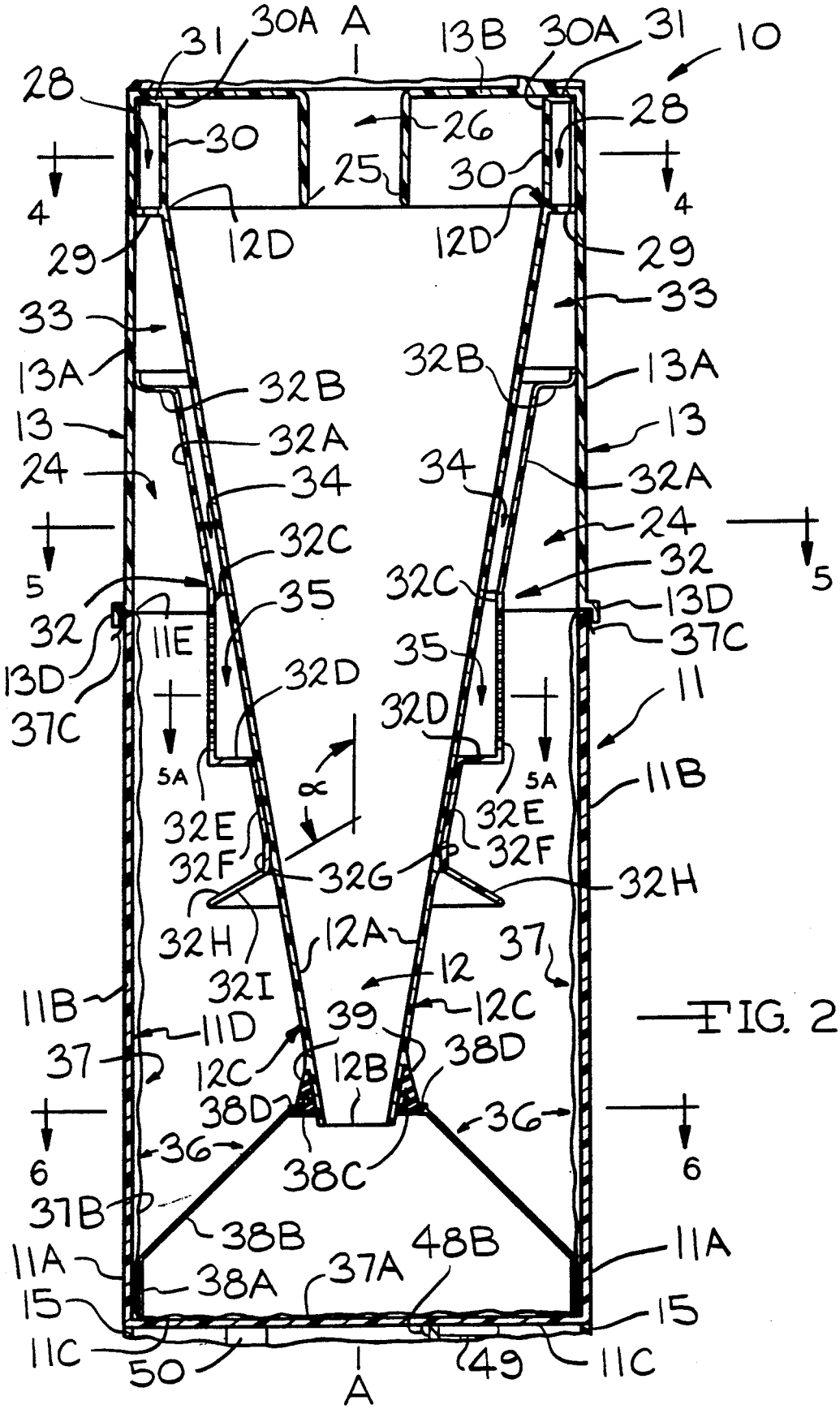

FIG. 2 is a front cross-sectional view along line 2—2 of FIG. 1 showing the shroud and disc unit 32 positioned between the inner cyclone 12 and the outer cyclone 11 and with the disposable liner 36 providing the rigid receiver 38 for the inner cyclone 12 and the flexible container portion 37 laying over the inside of the outer cyclone 11.

Figure 3:
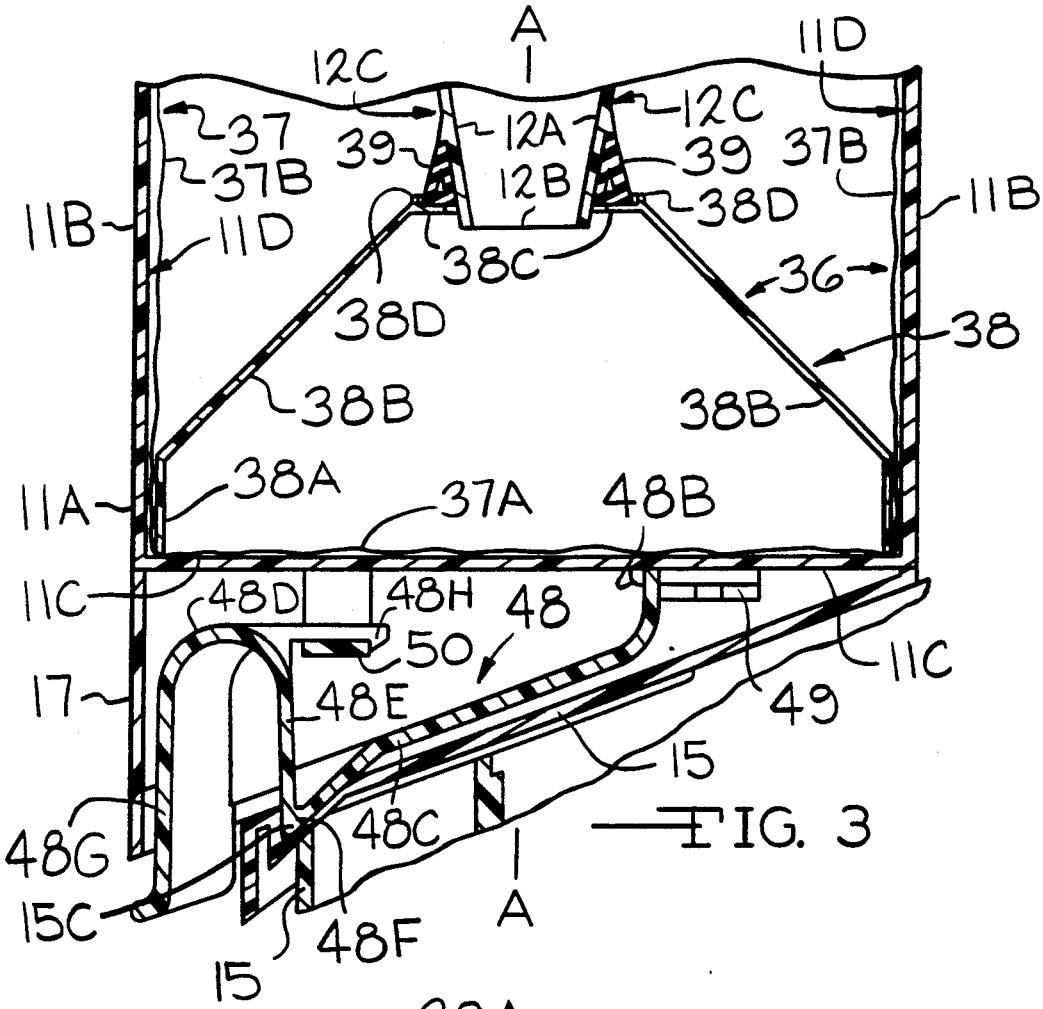

FIG. 3 is a front cross-sectional view along a plane perpendicular to line 2—2 of FIG. 1 showing a spring lever 48 for removing the outer cyclone 11 along with the disposable liner 36 comprising the flexible container portion 37 and the rigid receiver 38, from the cover 13 (shown in FIG. 1) and the inner cyclone 12.

Figure 4:
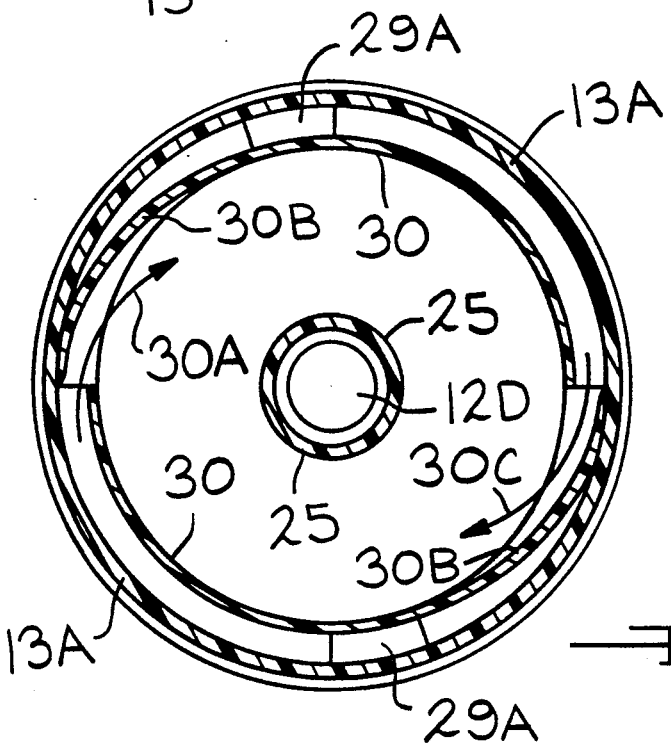

FIG. 4 is a plan cross-sectional view along line 4—4 of FIG. 2 showing the tangential air inlet 30C into the inner cyclone 20.

Figure 5:
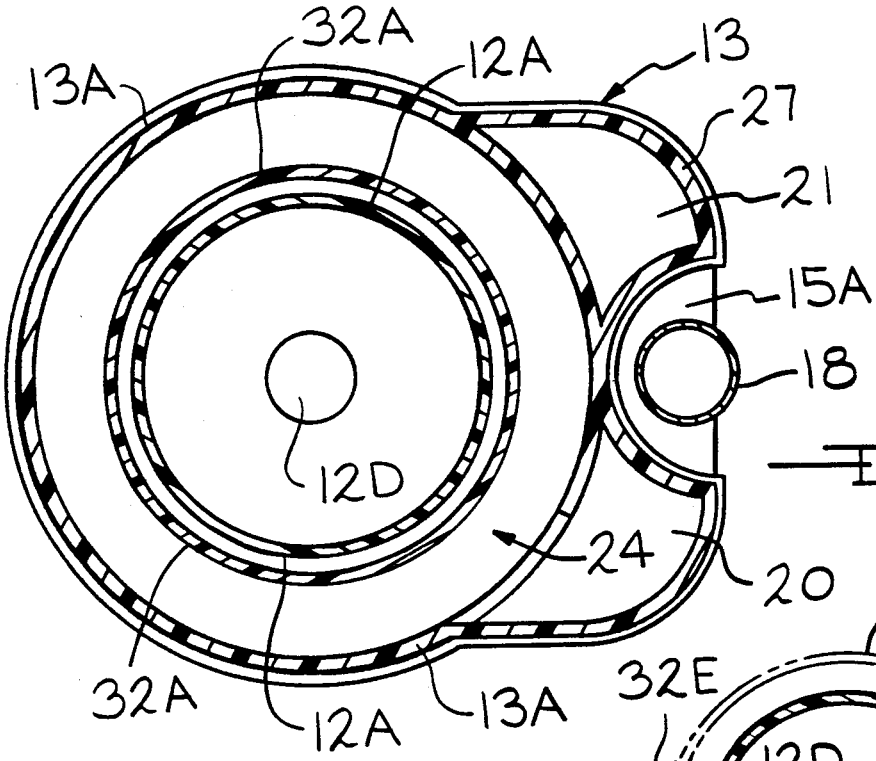

FIG. 5 is a plan cross-sectional view along line 5—5 of FIG. 2 showing the dirty air inlet passage 20, the clean air exhaust passage 21 and the intermediate wand 18 located on the outside of the casing extension 15A, adjacent to the cover 13.

Figure 5A:
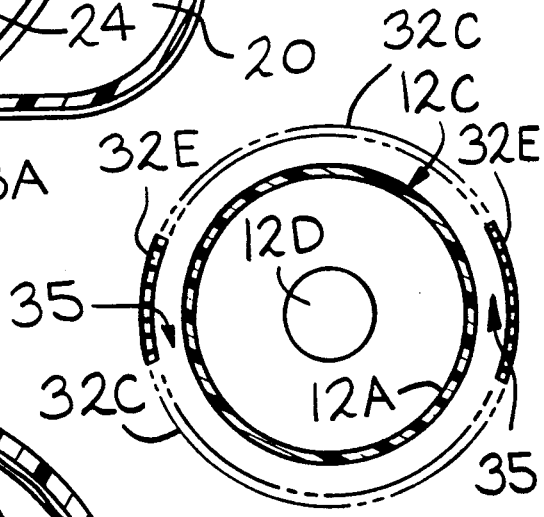

FIG. 5A is a plan cross-sectional view along line 5A—5A of FIG. 2 partially showing the perforated openings 32E through the shroud member 32C.

Figure 6:
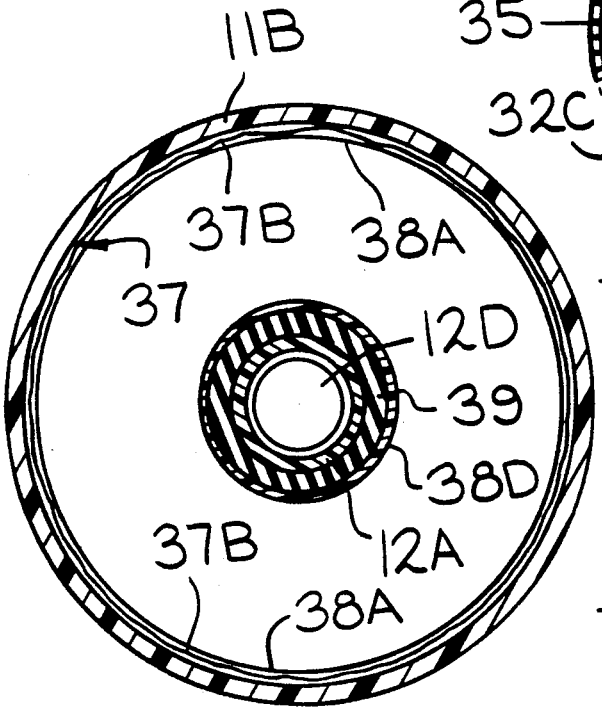

FIG. 6 is a plan cross-sectional view along line 6—6 of FIG. 2 showing container portion 37 of liner 36 laying over the inside of the outer cyclone 11 and a gasket 39 sealing the inner cyclone 12 to the receiver portion 38 of the liner 36.

Figure 7:
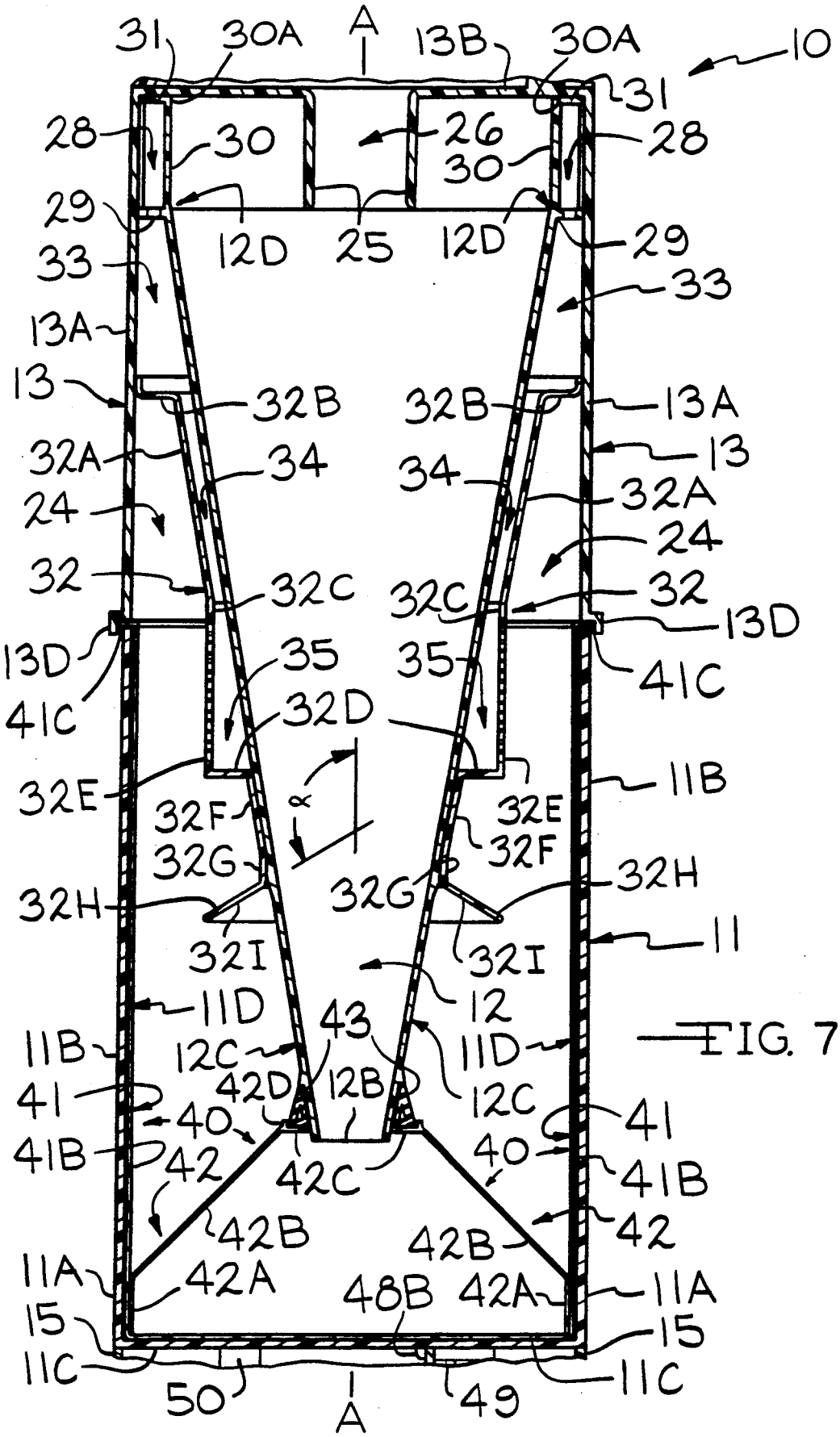

FIG. 7 is a front cross-sectional view of the cleaning apparatus 10 of FIG. 1 showing a rigid, disposable liner 40 mounted in the outer cyclone 11 and providing a container portion 41 covering the inside of the outer cyclone 11 and a receiver 42 for the inner cyclone 12.

Figure 8:
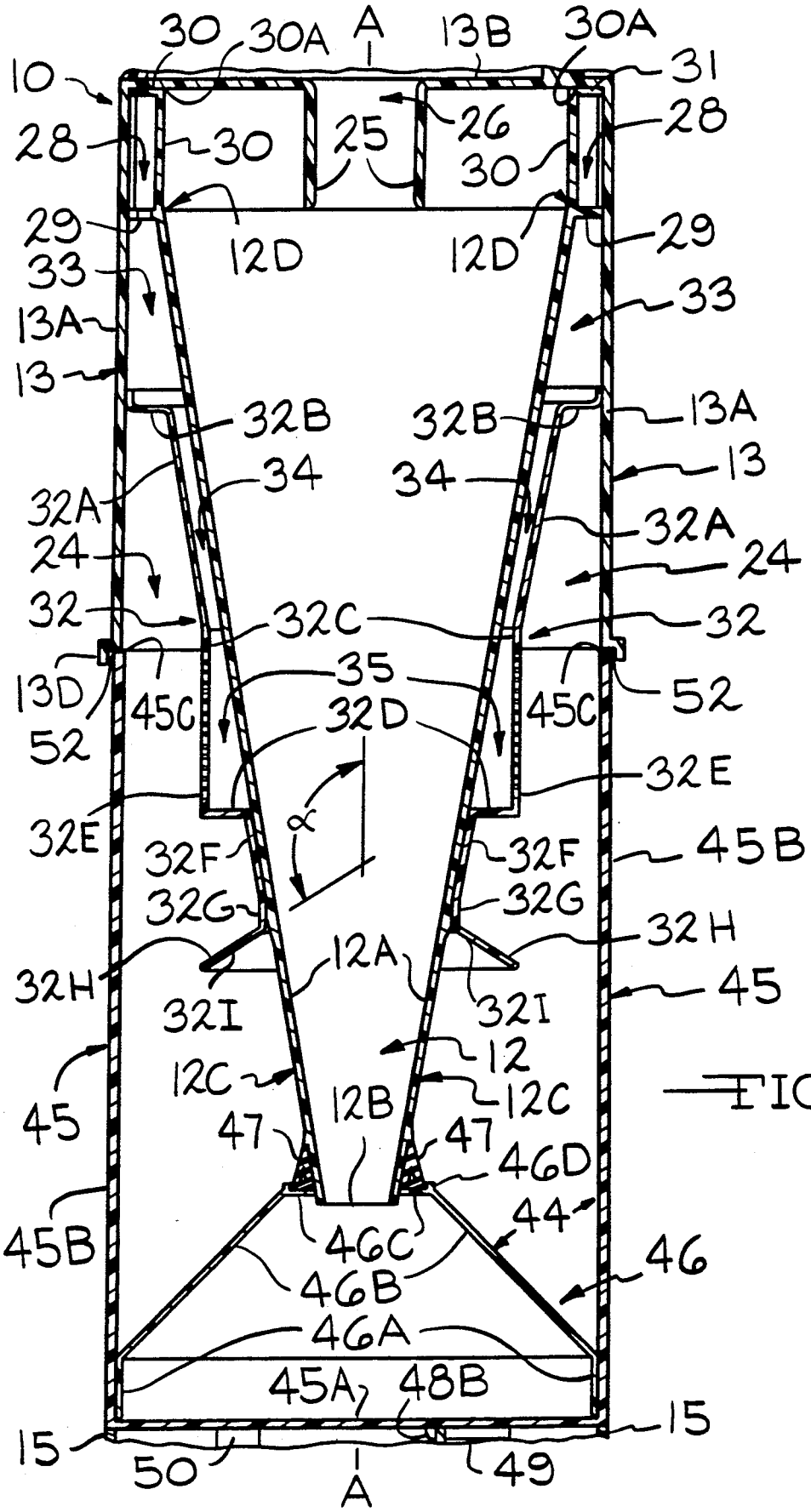

FIG. 8 is a front cross-sectional view of the cleaning apparatus 10 of FIG. 1 showing a disposable liner 44 providing an outer cyclone 45 and a receiver 46 for the inner cyclone 12.

Figure 9:
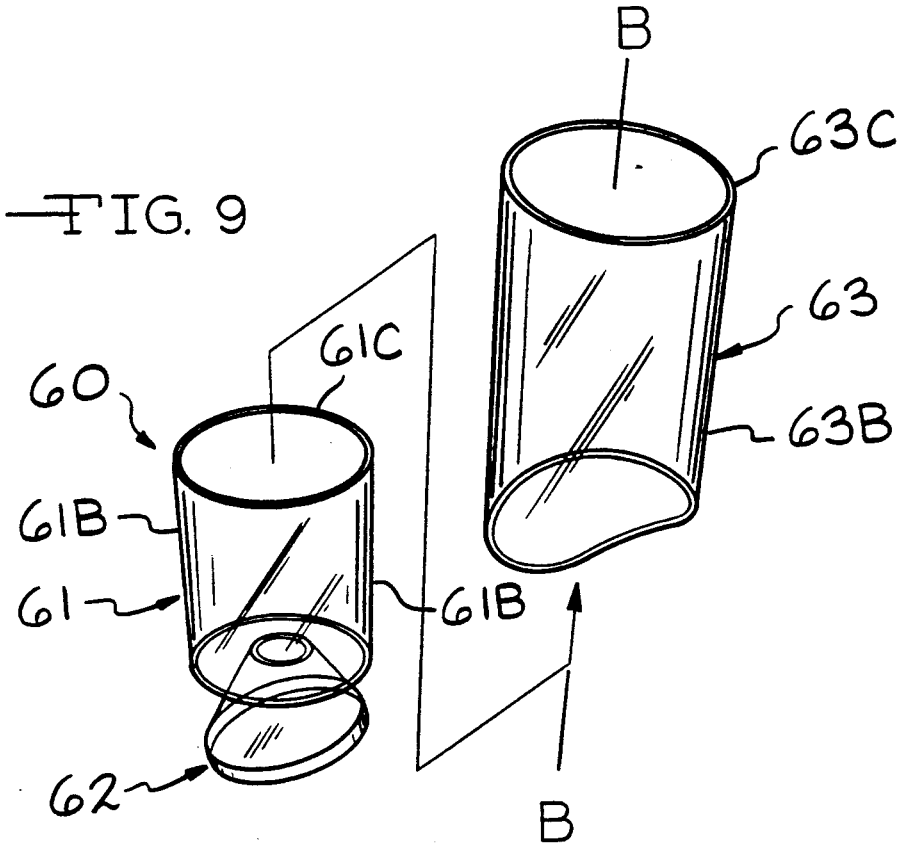

FIG. 9 is a perspective view of a disposable liner 60 comprised of a container portion 61 and a dirt receiver 62 that mounts inside of an outer cyclone 63 having a contoured bottom wall 63A to be supported by a casing (not shown) of an upright-type vacuum cleaning apparatus as shown in FIG. 1.

Figure 10:
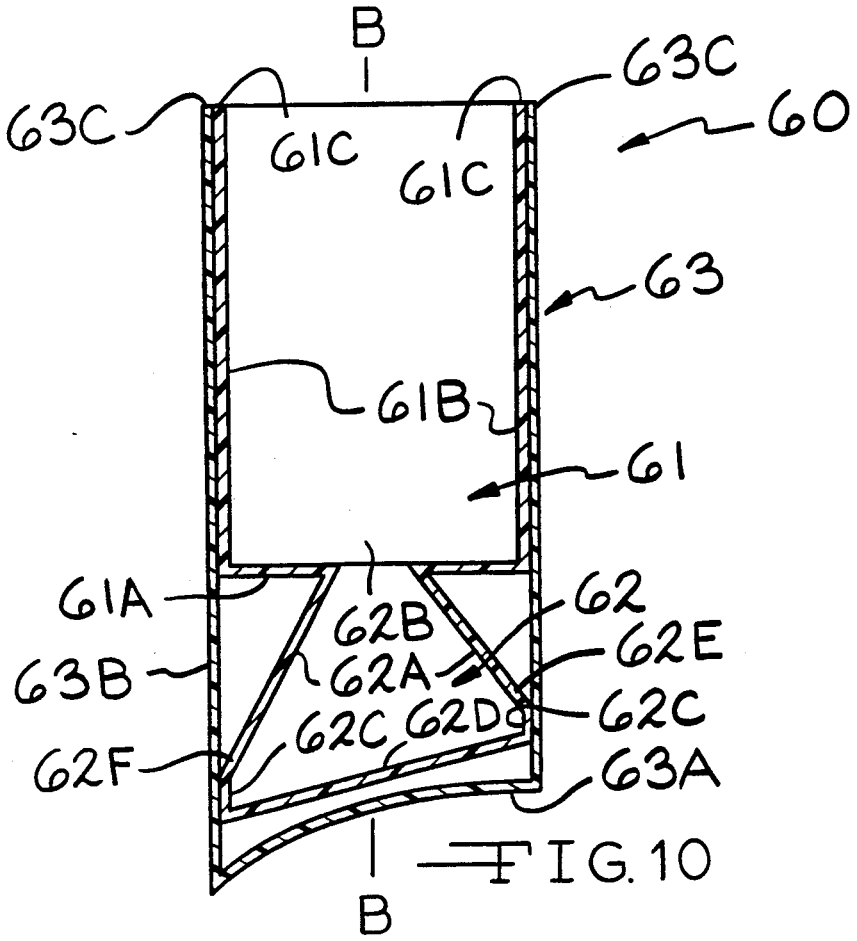

FIG. 10 is a cross-section of the disposable liner 60 shown in FIG. 9 and comprising the container portion 61 and dirt receiver 62 mounted inside the outer cyclone 63.

Figure 11:
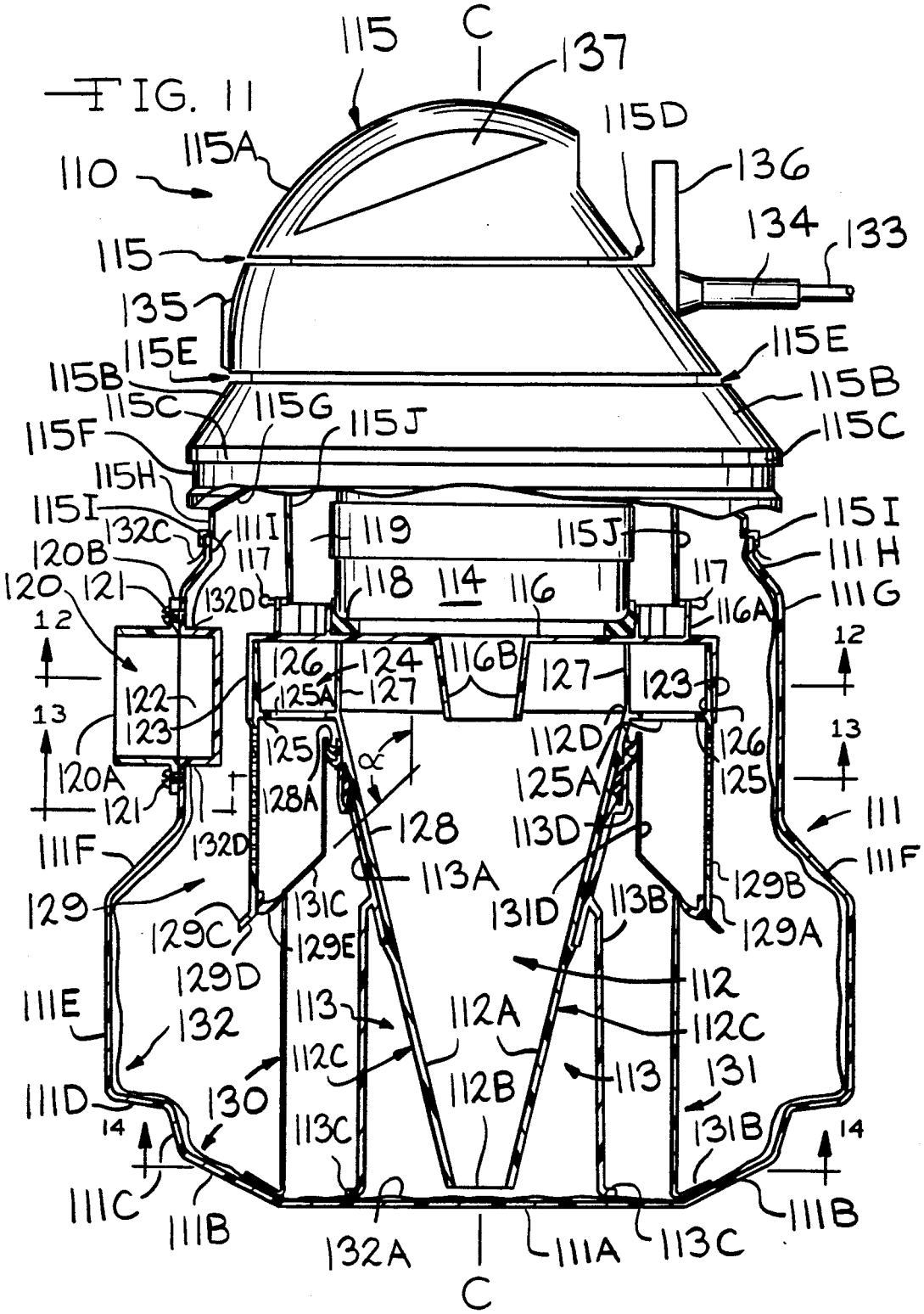

FIG. 11 is a front cross-sectional view of a tank type cleaning apparatus 110 showing a shroud and disc unit 129 positioned between the inner cyclone 112 and the outer cyclone 111 along with a disposable liner 130 having a container portion 132 laying over the inside of the outer cyclone 111 and a rigid receiver portion 131 for the inner cyclone 112.

Figure 12:
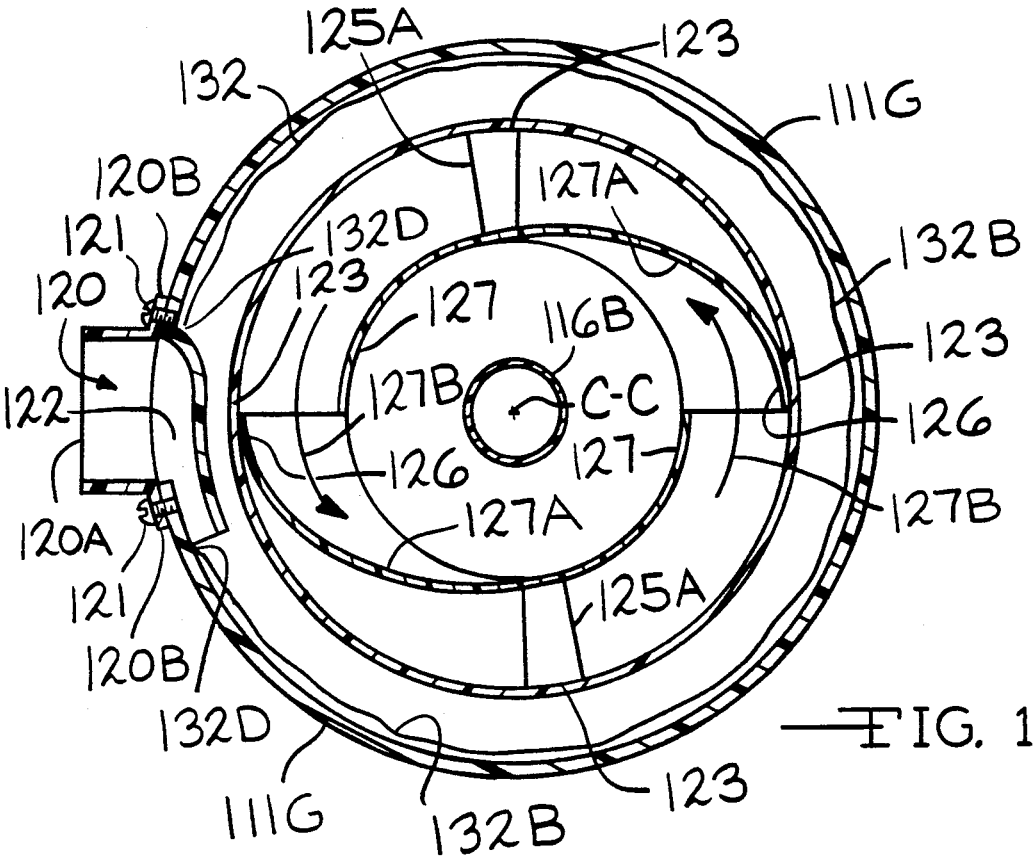

FIG. 12 is a plan cross-sectional view along line 12—12 of FIG. 11 showing the tangential air inlet 127B into the inner cyclone 112 with the container portion 132 of liner 130 laying inside the outer cyclone 111.

Figure 13:
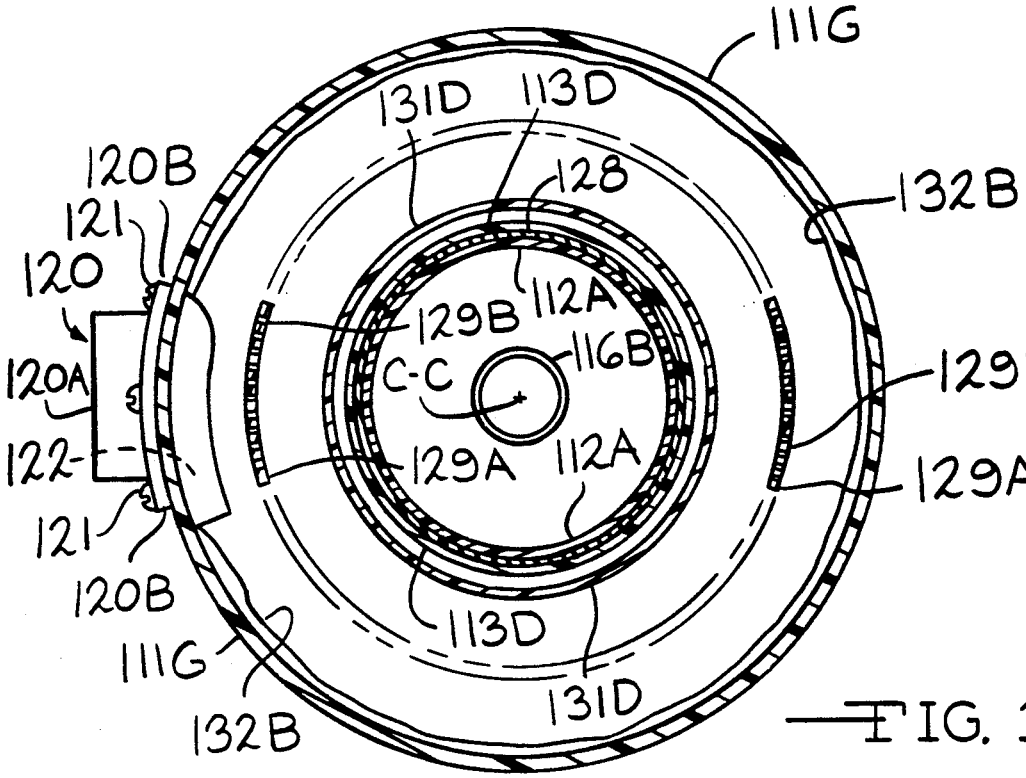

FIG. 13 is a plan cross-sectional view along line 13—13 of FIG. 11 partially showing the perforated openings 129B through the shroud member 129A and with the disposable liner 130 providing the rigid receiver 131 for the inner cyclone 112 and the flexible portion 132 laying over the inside of the outer cyclone 111.

Figure 14:
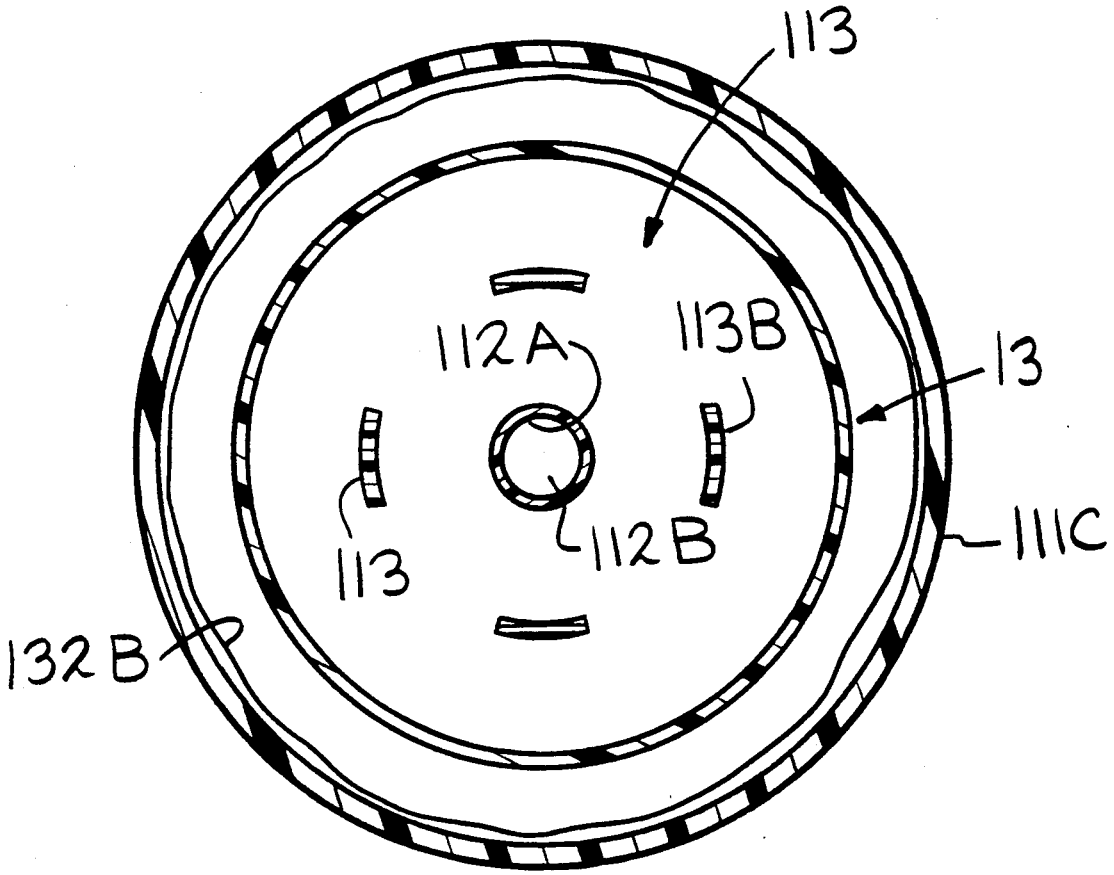

FIG. 14 is a plan cross-sectional view along line 14—14 of FIG. 11 showing the finger members 113B of the liner cage 113, which project from the outer surface 112C of the inner cyclone 112 to the base 111A of the outer cyclone 111 to hold the liner 132 on the base 111A.

GENERAL DESCRIPTION

The present invention relates to a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: a cover means providing a closure for an upper end of the container, wherein the cover means removeably supports the container for disposing of dirt separated from the airflow by the container; and a liner means having a first, rigid portion providing the receiver and a second portion wherein the receiver portion has a first sidewall between opposed ends, one of which is open and in a sealed relationship with the cyclone to provide for the dirt separated from the airflow by the cyclone to accumulate in the receiver portion and wherein the second portion of the liner means has opposed ends defining a second sidewall between the ends, the second sidewall mounted along and around the longitudinal axis, inside of the interior surface of the container so that the second portion of the liner means collects dirt separated from the airflow by the container and extends to an open end of the second portion sealed at the upper end of the container, wherein the container holding the second portion, is removeable from the cover means and the receiver portion is removeable from the sealed relationship with the cyclone for disposing of accumulated dirt separated from the airflow by the container and the cyclone.

Further, the present invention relates to a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: a cover means providing a closure for an upper end of the container, wherein the cover means removeably supports the container for disposing of dirt separated from the airflow by the container; and a rigid, collection means comprising a first portion providing the receiver and a second portion providing the container, wherein the receiver portion has a first sidewall between opposed ends, one of which is open and in a sealed relationship with the cyclone to provide for the dirt separated from the airflow by the cyclone to accumulate in the receiver portion of the collection means and wherein the container portion has opposed ends defining a second sidewall between the ends, the second sidewall mounted along and around the longitudinal axis, so that the container portion extends to an upper end removeably mounted to the cover means which forms a closure for the upper end of the container portion so that the container portion is removeable from the cover means to open the upper end of the container portion and the open end of the receiver portion is removeable from the sealed relationship with the cyclone for disposing of accumulated dirt separated from the airflow by the container and the cyclone.

Still further, the present invention relates to a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: a base means for the cleaning apparatus; a support means extending from the base means and supporting a cover means which supports the cyclone inside of the container; and a collection means comprising a first portion providing the receiver and a second portion providing the container, wherein the receiver portion has a first sidewall between opposed ends, one of which is open and in a sealed relationship with the cyclone to provide for the dirt separated from the airflow by the cyclone to accumulate in the receiver portion of the collection means and wherein the container portion has opposed ends defining a second sidewall between the ends, the second sidewall mounted along and around the longitudinal axis, so that the container portion extends to an upper end removeably mounted to the cover means as a closure for the upper end of the container portion and wherein the bottom of the container portion is moveable relative to the base means so that the container portion is removeable from the cover means to open the upper end of the container portion and so that the receiver portion is removeable from the sealed relationship with the cyclone for disposing of accumulated dirt separated from the airflow by the container and the cyclone.

Furthermore, the present invention relates to a cleaning apparatus comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: a base means for the cleaning apparatus; a support means extending from the base means and supporting a cover means which supports the cyclone inside of the container and provides a closure for an upper end of the container; a liner means having a first, rigid portion providing the receiver and a second portion wherein the receiver portion has a first sidewall between opposed ends, one of which is open and in a sealed relationship with the cyclone to provide for the dirt separated from the airflow by the cyclone to accumulate in the receiver portion and wherein the second portion of the liner means has opposed ends defining a second sidewall between the ends, the second sidewall mounted along and around the longitudinal axis, inside of the interior surface of the container so that the second portion of the liner means collects dirt separated from the airflow by the container and extends to an open end of the second portion sealed at the upper end of the container, wherein the container holding the second portion is removeable from the cover means and the receiver portion is removeable from the sealed relationship with the cyclone for disposing of accumulated dirt separated from the airflow by the cyclone and the container.

Still further, the present invention relates to a liner means for use in a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: the liner means to be mounted in the container and having a first, rigid portion providing the receiver and a second portion wherein the receiver portion has a first sidewall between opposed ends, one of which is open and in a sealed relationship with the cyclone to provide for the dirt separated from the airflow by the cyclone to accumulate in the receiver portion and wherein the second portion of the liner means has opposed ends defining a second sidewall between the ends, the second sidewall mounted along and around the longitudinal axis, inside of the interior surface of the container with an end of the second portion adjacent to the bottom of the container forming a bottom for the receiver portion at an end opposite the open end of the receiver portion, and wherein the second portion of the liner means collects dirt separated from the airflow by the container and extends to an open end of the second portion sealed at the upper end of the container, wherein the container holding the second portion, is removeable from the cover means and the receiver portion is removeable from the sealed relationship with the cyclone for disposing of accumulated dirt separated from the airflow by the cyclone and the container.

Furthermore, the present invention relates to a collection means for use in a cleaning apparatus including a container comprising a bottom and a sidewall extending to and meeting the bottom, the sidewall having an interior surface, a dirty air inlet at an upper portion of the container spaced form the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: the collection means comprising a first portion providing the receiver and a second portion providing the container, wherein the receiver portion has a first sidewall between opposed ends, one of which is open and in a sealed relationship with the cyclone to provide for the dirt separated from the airflow by the cyclone to accumulate in the receiver portion of the collection means and wherein the container portion has opposed ends defining a second sidewall between the ends, the second sidewall mounted along and around the longitudinal axis with an end of the container portion forming a bottom for the receiver portion at an end opposite the open end of the receiver portion wherein the container portion extends to an upper end which is removeably mounted to the cover means to form a closure for the container portion so that the container portion is removeable from the cover means to open the upper end of the container portion and the open end of the receiver portion is removeable from the sealed relationship with the cyclone for disposing of accumulated dirt separated from the airflow by the container and the cyclone.

Finally, the present invention relates to a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow form the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver extending from the cone opening; and means for generating an airflow which passes through the dirty air inlet, the container, the cyclone air inlet, the cyclone, the receiver and the cyclone air outlet, the airflow rotating around the frusto-conical interior surface of the cyclone and depositing the dirt in the receiver, the improvement which comprises: a cover means supporting the cyclone and providing a closure for an upper end of the container, and with the receiver positioned between the container and the cyclone; and a liner means having a first, rigid portion providing the receiver and a second portion mounted in the container wherein the receiver portion has a first sidewall between opposed ends, one of which is open and in a sealed relationship with the cyclone to provide for the dirt separated form the airflow by the cyclone to accumulate in the receiver portion and wherein the container portion of the liner means has opposed ends defining a second sidewall between the ends, the second sidewall mounted along and around the longitudinal axis, inside of the interior surface of the container with a first end of the container portion providing a closure for an opposed end of the receiver portion adjacent to the bottom of the container, and wherein a second, open end of the container portion lays over the upper end of the container so that when the cyclone is positioned inside of the container, the section of the container portion of the liner means laying over the upper end of the container is provided between the container and the cover means to seal the upper end of the container, wherein the cover means and the cyclone secure the receiver portion and the container portion inside the container with the receiver portion collecting dirt separated from he airflow by the cyclone and with the container portion collecting dirt separated from the airflow by the container, wherein the cover means and the cyclone are removeable from the container so that the liner means can be moved out of the container for removing the collected dirt from the vacuum cleaning apparatus.

My U.S. patent application Ser. No. 07/585,975, filed Sept. 21, 1990, describes a flexible liner for a dual inner and outer cyclonic vacuum cleaning apparatus. A closure member extends from he bottom of the outer cyclone to close the bottom of a receiver for the inner cyclone. The liner lays over the closure member to provide a seal between the outer cyclone and the receiver. For emptying the cleaning apparatus, the inner cyclone and receiver are separated form the outer cyclone so that the liner can be removed from the outer cyclone for disposing of accumulated dirt separated from the airflow by both the inner and outer cyclones. The present invention provides an alternative construction.

In the present invention, the upper end of the container is preferably provided with a seal to provide an airtight mounting between the outer cyclone and the cover. Various types of seals are contemplated by the scope of this invention. When the liner has a container portion that lays over the inner surface of the outer cyclone, an upper edge of its container portion cay lay over an upper edge of the sidewall of the outer cyclone. That way, the container portion provides a seal between the outer cyclone and the cover. The rigid container portion can also seal on the upper end of the outer cyclone. The seal can be an annular gasket or it can be a piece of tape that is mounted around the circumference of the container portion and adhered to the sidewall of the outer cyclone. The seal can also be a jam seal having an inverted J-shaped cross-section extending from the sidewall of the cover. The outer cyclone along with the container portion are then sealed to the cover with the outer cyclone mounting adjacent to the cover so that one portion of the jam seal mounts around the outer cyclone and the container portion, spaced radially from the cover.

When the liner provides the container or outer cyclone itself, the container can be sealed to an annular rim extending from the cover by an intermediate annular seal. The container can also be sealed to the cover with tape adhering to the cover and the container, or the container can be sealed to the cover by a jam seal as previously explained.

The present invention provides for the outer cyclone or container to be removeable from the cover and a base for the cleaning apparatus for disposing of dirt accumulated in the liner. The base has a downwardly sloped incline extending from the support to the front of the base. The bottom of the container has a similar slope, which provides for the container to slide away from the base and the support. Once the container has been removed from the base and the cover, the liner can then be removed from the container for disposing of accumulated dirt.

Dyson U.S. Pat. No. 4,571,772 shows a dual inner and outer cyclonic vacuum cleaning apparatus having dual spaced apart air conveyor pipes supporting a cap or cover for the cyclones. The cover is pivotable on the air pipes to move the outer cyclone away from a base for the cleaning apparatus. That way, the outer cyclone and the receiver for the inner cyclone can be removed from the cover for disposing of accumulated dirt.

In the present invention, however, the cover does not pivot with respect to the base and the support. Instead, the outer cyclone is removeable form the cover as explained above. That way, the liner is removeable from the outer cyclone for disposing of accumulated dirt.

The liner of the present invention can be made of plastic or paper or other material. Preferably, the receiver is made of a rigid, plastic material integrally bonded to the container portion which is a flexible plastic member. When the liner is mounted in the outer cyclone, the rigid receiver portion helps to position the flexible container portion in the outer cyclone. The container portion can also be made of a rigid plastic material that fits inside of the outer cyclone or, which provides the outer cyclone itself. Preferably, the liner material is transparent so that an operator can visually see when the vacuum cleaning apparatus is full of separated dirt. Preferably the liner is radially imperforate. Also, the liner is a disposable unit which can be either disposed of when the vacuum cleaning apparatus is full of accumulated dirt or, which can be emptied and reused in the cleaning apparatus.

The liner can be used in a modified upright vacuum cleaner similar to the type described in U.S. Pat. Nos. 4,593,429 and 4,826,515. The liner can also be used in a canister or tank type vacuum cleaner. The tank type cleaner usually has a removeable cover that exposes the liner. The upright vacuum cleaner has a fixed head which requires that he outer cyclone or container be removed from the fixed head to expose the liner. The liner can be also used in a backpack type or stick vac type of vacuum cleaner.

The tank type vacuum cleaner is preferably provided with finger projections intermediate the open end of the receiver and the cone opening. These projections extend from the outside wall of the cyclone to the base wall of the receiver. That way, the finger projections prevent the liner from moving towards the cone opening to block the cone opening.

Preferably the liner fits inside of the outer cyclone and is held in place by the combined weight of the finger projections, the inner cyclone, cover and motor fan unit. During operation of the vacuum cleaner, the dirt separating out of the airflow in the outer cyclone is deposited in the container portion of the liner and the dirt from the inner cyclone is deposited in the receive portion of the liner. The liner works well because when the outer cyclone and the dirt receiver become full of dirt, the operator can easily lift the liner out of the outer cyclone and replace it with a new one. The separated dirt is now contained in the liner where it can be cleanly deposited of. The liner also works well in single cyclonic vacuum cleaners.

SPECIFIC DESCRIPTION

FIGS. 1 to 8 show an upright type vacuum cleaning apparatus 10 which comprises an outer cyclone or container 11 mounted around an inner cyclone 12 which is supported inside the outer cyclone 11 by a cover 13 for the outer cyclone 11. The outer cyclone 11 and the inner cyclone 12 are preferably relatively long and slender along the longitudinal axis A—A. The cleaning apparatus 10 is adapted for use in both a vertical mode and a horizontal mode, the vertical mode being illustrated. The functioning of the cleaning apparatus 10 will be described with reference to the vertical mode shown.

As shown in FIG. 1, a cleaning head 14 is connected to a casing 15 which supports the outer cyclone 11. The casing 15 also supports a motor fan unit (not shown) that is mounted behind conventional floor engaging brushes (not shown) and inside wheels (not shown). Exterior wheels 16 are mounted behind the casing 15. A skirt 17 is mounted on a bottom portion 11A of the outer cyclone 11 and extends to the casing 15.

The outer cyclone 11 has a circular cross-section along a longitudinal axis A—A (FIG. 2) with an outside wall 11B extending from a bottom wall 11C. An inner surface 11D of the outside wall 11B has a circular cross-section along the longitudinal axis A—A. The outside wall 11B is preferably cylindrical, or it can have an outward taper extending toward the bottom portion 11A of the outer cyclone 11, if space and dimensions permit. The outer cyclone 11 is preferably made of a clear plastic material so that a person using the cleaning apparatus 10 can see the outer cyclone 11 fill with dirt.

The casing 15 is provided with a vertical extension 15A (FIG. 5) which forms a rigid socket for slideably receiving the lower end of a tubular pipe or wand 18. the wand 18 includes a hand grip 19. When the wand 18 is fitted in the extension 15A, the wand 18 and hand grip 19 serve as a handle to enable the appliance to be used as an upright type machine. In contrast, when the wand 18 is slideably removed from the extension 15A, the wand 18 is then used as a cleaner head at the end of a flexible hose (not shown), thus converting the appliance into a cylinder type machine. The conversion of the appliance from one mode of operation to the other and vice versa is described more fully in my U.S. Pat. No. 4,377,882.

As shown in FIGS. 1 and 5, positioned adjacent to the outside wall 11B of the outer cyclone 11 and mounting an outside wall 13A of the cover 13, on opposed sides of wand 18, are spaced apart dirty air inlet and clean air exhaust passages 20 and 21, respectively. The lower half of dirty air inlet passage 20 is formed by a rigid tube 22 adjacent to the outside wall 11B of the outer cyclone 11, as shown in FIG. 1. Tube 22 extends form a dirty air inlet passage (not shown) in casing 15 to a tube 23 mounted on the outside wall 13A of the cover 13 which forms the upper half of dirty air inlet passage 20, (FIG. 5). Tube 23 communicates through the upper part of the outside wall 13A of the cover 13 through inlet passage 24 so as to make a tangential entry and set up a swirling, cyclonic flow of air in passage 24 of the cover 13 leading to the outer cyclone 11.

As shown in FIG. 2, depending form the circular plate 13B of cover 13 is conduit 25 which forms a clean air exhaust passage 26 form the inner cyclone 12. Exhaust passage 26 is in communication through cover 13 with the upper half of clean air exhaust passage 21 (FIG. 5) which is formed by tube 27 mounted on the outside wall 13A of the cover 13. The lower part of tube 27 leads to a rigid lower exhaust tube (not shown) which is mounted on the outside wall 11B of the outer cyclone 11. The lower exhaust tube forms the lower half of clean air exhaust passage 21 and connects to a clean air exhaust outlet (not shown) in the casing 15 which cools the motor fan unit and exhausts at casing vents 15B below skirt 17 as shown in FIG. 1.

The inner cyclone 12 has a frusto-conical body extending radially downwardly and inwardly to the axis A—A and an inlet scroll 28. The inner cyclone 12 comprises an inner wall 12A leading to a cone opening 12B and an outer surface 12C of the inner wall 12A. The inlet scroll 28 comprises a horizontal web 29 (FIG. 2) which extends from the upper end surface 12D of the inner cyclone 12 to the inner surface 13C of the cover 13. A sleeve 30 extends through the majority of its length from the junction of the upper end surface 12D of the inner cyclone 12 and web 19 to the bottom side of plate 13B. A second horizontal web 31 extends from the upper end 30A of sleeve 30 to the junction where the inner surface 13C of cover 13 meets plate 13B. A pair of spiral portion 30B (FIG. 4) of sleeve 30 extend in the form of spirals from the junction of the upper end surface 12D of the inner cyclone 12 and the web 29 to the inner surface 13C of the cover 13, thereby completing the inlet scroll 28. Although a pair of spiral portions 30B are shown in FIG. 4, the inlet scroll 28 can be completed by an number of spiral portions 30B. What is important, is that the spiral portions 30B provide a tangential entry to the inner cyclone 12, as shown by arrows 30C, in order to be capable of setting up a swirling, cyclonic flow of air in the inner cyclone 12.

A combined shroud and disc unit 32 is mounted intermediate a passage 33 leading through openings 29A in web 29 to inlet scroll 28, and the cone opening 12B, as particularly shown in FIG. 2. The upper part of the unit 32 is tapered with wall 32A preferably parallel to the outer surface 12C of the inner cyclone 12 and forming passage 34 leading to passage 33 and inlet scroll 28 for the inner cyclone 12. The wall 32A ends in a flange 32B which surrounds and encloses the inlet passage 33. Cylindrical section 32C depends from the lower end of wall 32A to an annular web 32D. A plurality of openings 32D (partially shown in FIG. 5A) are provided in and around the circumference of the cylindrical section 32C and serve as an outlet form the outer cyclone 11 to passage 35 leading to passage 34. Web 32D extends between the cylindrical section 32C and the outer surface 12C of the inner cyclone 12 where it meets conical member 32F leading to a cylindrical section 32G. Depending form the cylindrical section 32G is a disc 32H which can be conically shaped with a large downwardly tapered portion 32I facing the bottom wall 11C of the outer cyclone 11. The disc 32H can have a downwardly inclined angle alpha between about 97½° to 110° form the axis a—a 7½° to 20° from a line perpendicular to the axis a—a. The disc 32H can also be perpendicular to the axis A—A (not shown). The operation of the shroud and disc unit 32 is described more fully in my U.S. patent application Ser. No. 07/621,375, filed Dec. 3, 1990.

As shown in FIG. 2, a disposable liner 36 is mounted inside of the outer cyclone 11. The liner 36 is an integral unit having a container portion 37 covering the inside of the outer cyclone 11 and a dirt collecting receiver 38 for the inner cyclone 12. The container portion 37 is a flexible, bag shaped member that is made of paper or a plastic material such as polyethylene. The container portion 37 has a bottom section 37A extending to a sidewall section 37B and covers the entire inside of the outer cyclone 11, including the bottom wall 11C and the inner surface 11D. That way, the container portion 37 collects larger dirt particles separated from the airflow by the outer cyclone 11. An annular rim 13D extends form a lower end of the cover 13 and mounts over an upper edge 11E of the outer cyclone 11, radially outside of the outside wall 11B. An upper section 37C of the container portion 37 extends up and over the upper edge 11E of the outer cyclone 11 to form an airtight seal between the outer cyclone 11 and the cover 13.

The receiver 38 i s a rigid portion of the liner 36 and collects smaller dirt particles separated from the airflow by the inner cyclone 12. The receiver 38 has a cylindrical section 38A mounted on the bottom wall 11C of the outer cyclone 11. The cylindrical section 38A is bonded to the sidewall section 37B of the container portion 37 adjacent to the bottom portion 11A of the outer cyclone 11 and extends to a frusto-conical section 38B that tapers upwardly and inwardly towards the axis A—A and the cone opening 12B. An upper extent of the frusto-conical section 38B forms a mounting ledge 38C which contacts a flexible annular seal 39 mounted on the inner cyclone 12. The flexible seal 39 has a triangular cross-section around the axis A—A and is mounted on the outer surface 12C, spaced above the cone opening 12B, so that the cone opening 12B extends beneath the ledge 38C and into the receiver 38. An annular rim 38D extends upward from the junction of the frusto-conical section 38B and the ledge 38C, radially outside of the flexible seal 39 so that the seal 39 seats on the ledge 38C to form an airtight releasable mounting between the inner cyclone 12 and the outer cyclone 11. The diameter of the cone opening 12B across the axis A—A is preferably at least three times the diameter of the frusto-conical section 38B, as described in U.S. Pat. No. 4,826,515.

FIG. 7 shows another version of a disposable liner 40 mounted inside of the outer cyclone 11. The liner 40 is an integral unit having a container portion 41 covering the inside of the outer cyclone 11 and a dirt collecting receiver 42 for the inner cyclone 12. The container portion 41 is a rigid member comprised of a bottom section 41A extending to a sidewall section 41B. The container portion 41 covers the entire inside of the outer cyclone 11, including the bottom wall 11C and the inner surface 11D. That way, the container portion 41 collects larger dirt particles separated from the airflow by the outer cyclone 11. An annular ledge 41C extends from an upper edge portion of the sidewall section 41B and mounts between the outer cyclone 11 and the cover 13. The annular ledge 41C abuts against an inner surface of the annular rim 13D of the cover 13 to form a seal between the outer cyclone 11 and the cover 13. The container portion 41 is preferably made of a plastic material that is transparent so that an operator can visually see the container portion 41 fill with dirt.

The disposable liner 40 is completed by the rigid receiver 42 which is similar to the receiver 38 of liner 36. Receiver 42 has a cylindrical section 42A mounted on the bottom section 41A of the container portion 41. The cylindrical section 42A is bonded to the sidewall 41B of the container portion 41 to form the integral liner 40. The cylindrical section 42A meets a frusto-conical section 42B that extends upwardly and inwardly towards the axis A—A to form an annular mounting ledge 42C. Ledge 42C extends to the outer surface 12C of the inner cyclone 12, adjacent to the cone opening 12B and provides for mounting a flexible annular seal 43. Seal 43 is mounted on the outer surface 12C of the inner cyclone 12. Flexible seal 43 has a triangular cross-section around the axis A—A and seals against the ledge 42C so that the cone opening 12B extends beneath the ledge 38C, and into the receiver 42. An annular rim 42D extends upwards from the junction of the frusto-conical section 42B and the ledge 42C, radially outside of the flexible seal 43 so that the seal 43 seats on the ledge 42C to form an airtight releasable mounting between the inner cyclone 12 and the outer cyclone 11.

FIG. 8 shows still another version of the unitary and disposable liner 44. The liner 44 is an integral unit having a container 45 and a dirt collection receiver 46 for the inner cyclone 12. The container 45 is a rigid member and serves as an outer cyclone to remove larger dirt particles from the airflow through the cleaning apparatus 10. The container 45 is comprised of a bottom wall 45A with a sidewall 45B extending from an outer periphery of the bottom wall 45A to the cover 13. The cover 13 mounts over an upper edge 45C of the sidewall 45B with the annular rim 13D of the cover 13 mounted radially outside of the sidewall 45B. An annular seal 52 is provided between the annular rim 13D of cover 13 and the upper edge 45C of the container 45 to form a releasable seal between the container 45 and the cover 13.

The disposable liner 44 is completed by the rigid receiver 46 which is similar to the receivers 38 and 42. Receiver 46 has a cylindrical section 46A mounted on the bottom wall 45A of the container 45. The cylindrical section 46A is bonded to the sidewall 45B of the container 45 to form the integral liner 44. The cylindrical section 46A meets a frusto-conical section 46B that extends upwardly and inwardly towards the axis A—A to form an annular mounting ledge 46C. Ledge 46C extends to the outer surface 12C of the inner cyclone 12, adjacent to the cone opening 12B and provides for mounting a flexible annular seal 47. Seal 47 is mounted on the outer surface 12C of the inner cyclone 12. Flexible seal 47 has a triangular cross-section around the axis A—A and seals against the ledge 46C so that the cone opening 12B extends beneath the ledge 46C and into the receiver 46. An annular rim 46D extends upwards from the junction of the frusto-conical section 46B and the ledge 46C, radially outside of the flexible seal 47 so that the seal 47 seats on the ledge 46C to form an airtight, releasable mounting between the inner cyclone 12 and the container 45.

In operation of the preferred version of the upright type vacuum cleaning apparatus 10 as shown in FIG. 2, the motor fan unit (not shown) mounted in casing 15 pulls an airflow into dirty air inlet passage 20 through tubes 22 and 23 and into inlet passage 24 leading to the outer cyclone 11. The airflow cyclones down and around the sidewall section 37B of the liner 36, mounted on the inner surface 11D of the outer cyclone 11 and over the frusto-conical section 38B of the receiver portion 38 to deposit larger dirt particles in the container portion 37 of the liner 36. The airflow then moves up the outer surface 12C of the inner cyclone 12 and over the disc 32H, through the openings 32E in the cylindrical section 32C before moving up passages 35 and 34 defined between the shroud 32 and the outer surface 12C of the inner cyclone 12. The airflow then moves into passage 33 and enters the inlet scroll 28 for the inner cyclone 12 through an opening 29A (FIG. 4) in web 29. In the inner cyclone 12, the airflow cyclones down the inner wall 12A to the cone opening 12B to deposit finer dirt particles in the receiver 38 before moving upward to the exhaust passage 26 defined by the tube 25. The airflow continues through a lower exhaust tube (not shown) adjacent to the outside wall 11B of the outer cyclone 11, before passing over the motor fan unit to cool the unit and exhausting to the atmosphere. The separated dirt collects on the frusto-conical section 38B of the receiver portion 38 and on the bottom section 37A of the container portion 37. Finer dirt collects primarily in the receiver 38.

As shown in FIG. 3, the outer cyclone 11 and the liner 36 are removeable from the cover 13 for emptying the dirt separated from the airflow by releasing a spring lever 48 housed within the skirt 17. The lever 48 comprises a central spring arm 48A that attaches at its proximal end 48B to the bottom wall 11C of the outer cyclone 11 through mounting bracket 49. The distal end 48C of the arm 48A forms into a first inverted U-shaped member 48D. The spring arm 48A and a proximal leg 48E of the first inverted U-shaped member 48D form a U-shaped junction 48F that secures into a mating locking member 15C mounted on the casing 15. A distal leg 48G of the first inverted U-shaped member 48D acts as a finger grip that protrudes out from underneath the skirt 17, adjacent to the casing 15. A second inverted U-shaped guide member 50 is mounted on the bottom wall 11C of the outer cyclone 11, spaced from mounting bracket 49 and adjacent to the apex of the first inverted U-shaped member 48D. The second inverted U-shaped member 50 serves as a guide for an arrow tab 48H extending from the first inverted U-shaped member 48D of the lever 48 which helps to secure the outer cyclone 11 to the cover 13 and the inner cyclone 12 when the vacuum cleaning apparatus 10 is being used.

When the outer cyclone 11 and the receiver 38 become full of accumulated dirt, the operator lifts up on the distal leg 48G of the first inverted U-shaped member 48D. This releases the junction 48F of lever 48 from the locking member 15C and the arrow tab 48H from the second inverted U-shaped member 50. The operator then pulls the outer cyclone 11 holding the liner 36 away from the handle 18 (FIG. 1). This causes the upper edge 11E of the sidewall 11B of the outer cyclone 11 to release from the cover 13 at the annular rim 13D, and the receiver 38 to release from the inner cyclone 12 at the mounting of the seal 39 and the ledge 38C of the receiver 38, thereby exposing the rigid tube 22, the rigid lower exhaust tube (not shown) and the bottom part of the intermediate pipe 18. The liner 36 including the container portion 37 and the receiver 38 can then be removed from the outer cyclone 11 to dispose of the dirt separated from the airflow by the outer cyclone 11 and the inner cyclone 12. The liner 36 can be disposed of itself and replaced with another liner 36, or the liner 36 can be emptied and replaced inside of the outer cyclone 11.

When the liner 36 is fitted into the outer cyclone 11, the rigid receiver 38 acts to position the flexible container portion 37 on the bottom portion 11A of the outer cyclone 11. The sidewall 37B of the container portion 37 is then positioned in the outer cyclone 11 with the upper section 37C laying over the upper edge 11E of the outer cyclone 11. The outer cyclone 11 is then replaced into the vacuum cleaning apparatus 10 by fitting the upper edge 11E inside the annular rim 13D of the cover 13. The operator then pushes the outer cyclone 11 towards the pipe 18 until the junction 48F of lever 48 locks into locking member 15C of casing 15 and arrow tab 48H secures into U-shaped member 50. At this point, the receiver 38 is sealed to the inner cyclone 12 with seal 39 seated on ledge 38C. The outer cyclone 11 is further sealed to the cover 13 with the upper section 37C sealing between the upper edge 11E of the outer cyclone 11 and the annular rim 13D of the cover 13.

As shown in FIG. 7, to dispose of accumulated dirt in liner 40, the outer cyclone 11 is removed from the cover 13 in a manner as described above. Once the outer cyclone 11 is free of the cover 13, the rigid liner 40 can be removed from the outer cyclone 11 to dispose of dirt separated from the airflow by the outer cyclone 11 and the inner cyclone 12 and deposited in the respective container portion 41 and receiver 42 of the liner 40. The liner 40 can be disposed of and replaced by another liner 40, or the liner 40 can be emptied and replaced in the outer cyclone 11 for reuse. Once the liner 40 is fitted inside of the outer cyclone 11, outer cyclone 11 is replaced into the vacuum cleaning apparatus 10 by fitting the upper edge 11E inside of the annular rim 13D of the cover 13. The operator then pushes the outer cyclone 11 towards the pipe 18 to lock the outer cyclone 11 in place with lever 48 as described above. The receiver 42 is now sealed to the inner cyclone 12 with seal 39 seated on ledge 38C and container 41 is sealed to the cone 13 by the annular ledge 41C and annular rim 13D.

As shown in FIG. 8, to dispose of accumulated dirt in liner 44, the container portion 45 of liner 44 which serves as the outer cyclone, is removed from the cover 13 in a manner as described. Once the liner 44 has been removed from the cover 13 and the inner cyclone 12, the liner 44 can be disposed of and replaced by another liner 44, or the liner 44 can be emptied and remounted to the outer cyclone 11 for reuse. The liner 44 is replaced into its vacuum cleaning apparatus 10 by fitting the upper edge 45C of the container 45 inside of the annular rim 13D of the cover 13. The operator then pushes the container 45 towards the pipe 18 to lock the container 45 in place with lever 48 as described above. The receiver 46 is now sealed to the inner cyclone 12 with seal 39 seated on ledge 38C and the container 46 is sealed to the cover 13 by the annular rim 13D.

FIGS. 9 and 10 show yet another version of the unitary and disposable liner 60. The liner 60 is an integral unit having a container portion 61 and a dirt collection receiver 62 for the inner cyclone 12 (inner cyclone 12 is not shown in FIG. 12). The liner 60 is mounted inside of the outer cyclone 63, which is similar to the outer cyclone 11 shown in FIGS. 1 to 7. The outer cyclone 63 is a rigid member with a circular cross-section along the axis B—B. The outer cyclone 63 is comprised of a bottom wall 63A and a sidewall 63B that extends from an outer periphery of the bottom wall 63A. The bottom wall 63A has an arcuate shape when viewed in cross-section from a side view. The contour of the bottom wall 63A enables the outer cyclone 63 to be removeably supported on a casing (not shown) for an upright-type vacuum cleaner apparatus 10 similar to the one shown in FIG. 1. The sidewall 63B extends from the bottom wall 63A to an upper edge 63C forming an opening for the outer cyclone 63. The upper edge 63C seals on a cover (not shown), similar to cover 13 shown in FIG. 1. The cover provides a closure for the upper edge 63B when the outer cyclone 63 is mounted in the upright-type vacuum cleaning apparatus 10. The outer cyclone 63 is a rigid member that is preferably made of a transparent material so that an operator can see the outer cyclone 63 fill with accumulated dirt.

The container portion 61 of liner 60 is a rigid member that covers the inside of the outer cyclone 63 to collect dirt separated from the airflow by the outer cyclone 63. The container portion 61 of liner 60 is also preferably made of a transparent material that helps indicate when the container portion 61 is full of accumulated dirt. The container portion 61 is comprised of a bottom wall 61A, which is circular in plan view, and a cylindrical sidewall 61B that extends from an outer periphery of the bottom wall 61A to an upper edge 61C of the sidewall 61B. The upper edge 61C is preferably flush with the upper edge 63C of the outer cyclone 63. This enables the container portion 61 to be closed by the cover (not shown) when the liner 61 is mounted in the outer cyclone 63 and the outer cyclone 63 is mounted in a upright-type vacuum cleaner apparatus 10.

The dirt collection receiver 62 serves to collect dirt separated from the airflow by the inner cyclone 12 (inner cyclone 12 is shown in FIGS. 1 to 8) and has a frusto-conical sidewall 62A that depends from an open end 62B, downwardly and outwardly along the axis B—B to a cylindrical member 62C. The open end 62B of receiver 62 joins with the bottom wall 63A of the container portion 63 to form the unitary liner 60. The cylindrical member 62C of receiver 62 extends downwardly to a bottom wall 62D of the receiver 62. As shown in FIG. 10, the dirt receiver 62 has a somewhat forward tilt so that the bottom wall 62D inclines downwardly from the back portion 62E to the front portion 62F of the receiver 62. This increases the volumn of the receiver 62 to take advantage of the arcuate shape of the bottom wall 63A of the outer cyclone 63, as explained above.

That way, when the outer cyclone 63 is removed from the vacuum cleaner apparatus 10 by a releasable lever (not shown), which is similar to the liner 48 shown in FIG. 3, the liner 60 can be removed from the outer cyclone 63 through the upper end of the sidewall 63B of the outer cyclone 63. The liner 60 can then be deposited of and replaced with a new liner 60, or the liner 60 can be emptied and reused in the outer cyclone 63. The outer cyclone 63 is then remounted in the vacuum cleaner apparatus 10 as described above with respect to the outer cyclone 11.

FIG. 11 shows a tank type or cylinder type vacuum cleaning apparatus 110, which comprises an outer cyclone 111 mounted around an inner cyclone 112, with an associated liner cage 113 and a motor driven fan unit 114 mounted underneath a cover 115 for the outer cyclone 111. The inner and outer cyclones 111 and 112 have circular cross-sections along a longitudinal axis C—C. The outer cyclone 111 has a base 111A with a first frusto-conical member 111B extending from an outer perimeter of the base 111A. The first frusto-conical member 111B extends upwardly and outwardly along the axis C—C to meet a second frusto-conical member 111C. The second frusto-conical member 111C also extends upwardly and outwardly along the axis C—C to a third frusto-conical member 111D. The third frusto-conical member 111D meets a first cylindrical member 111E which extends to a fourth frusto-conical member 111F. The fourth frusto-conical member 111F extends upwardly and inwardly along the axis C—C to a second cylindrical member 111G. The second cylindrical member 111G extends along the axis C—C to a fifth frusto-conical member 111H which extends upwardly and inwardly along the axis C—C to a third cylindrical member 111I which completes the outer cyclone 111.

The removeable cover 115 serves as a closure for the outer cyclone 111. The cover 115F has generally hemispherically outside wall 115A that extends along the axis C—C to frusto-conical section 115B that extends downwardly and outwardly along the axis C—C to an annular rim 115C, which serves as a hand grip for removing the cover 115 from the outer cyclone 111. The hemispherically shaped outside wall 115A also provides for a first vent 115D for introducing cooling airflow to the motor fan unit 114 and a second vent 115E at the junction of the outside wall 115A and the frusto-conical section 115B for venting the cooling airflow to the atmosphere. Spaced below and formed in part by the annular rim 115C is a third annular vent 115F that serves as a clean air outlet for the vacuum cleaning apparatus 110.

A frusto-conical member 115G depends from an inside portion of the cover 115 to a cylindrical member 115H. An annular ledge 115I having an inverted L-shaped cross-section depends from a lower edge of the cylindrical member 115H. The ledge 115I mounts on the outer cyclone 111, radially outside of the cylindrical member 111I to form a seal between the cover 115 and the outer cyclone 111.

The cover 115 also supports a cylindrical member 115J which depends from the cover 115 radially inside of the members 115G, 115H and 115I. A plate 116, circular in plan view, has an annular sleeve 116A that is connected to the cylindrical member 115J by bolts 117. A motor seal 118 is mounted on plate 116 and supports the motor driven fan unit 114 to absorb some of the sound created when the motor fan unit 114 is running. An exhaust conduit 116B depends from the plate 116 and serves as a passage to exhaust the cleaned airflow from the inner cyclone 112.

A cylindrical dirty air inlet passage 120 communicates through the upper part of the cylindrical member 111G, forming part of the outside wall for the outer cyclone 111. An end part 120A of the dirty air inlet passage 120, remote from the outer cyclone 111, is joined by a flexible tube (not shown) to a cleaner head (not shown) for contacting a dirty surface. Flanged section 120B of inlet passage 120 is secured by screws 121 to the outside wall 111G of the outer cyclone 111. Inlet passage 120 leads to a dirty air passage 122. As long as inlet passage 122 communicates through the upper part of the outside wall of the outer cyclone 111 so as to make a tangential entry and to set up a swirling, cyclonic flow of air in the outer cyclone 111, the exact position of the inlet passage 122 around the circumference of the outer cyclone 111 is not critical.

A second annular sleeve 123 depends from an outer periphery of the plate 116 to support an inlet scroll 124 for the inner cyclone 112. The inner cyclone 112 has a frusto-conical body extending radially downwardly and inwardly to the axis C—C. The inner cyclone 112 comprises an inside wall 112A leading to a cone opening 112B and an outer surface 112C of the inside wall 112A. The inlet scroll 124 comprises a horizontal web 125 which extends from the upper end surface 112D of the inner cyclone 112 to an annular sleeve 126. Sleeve 126 is mounted to the inner surface of the sleeve 123. A second sleeve 127 extends through the majority of its length from the junction of the upper end surface 112D of the inner cyclone 112 and web 125 to the bottom side of plate 116. A pair of spiral portions 127A (FIG. 12) of sleeve 127 extend in the form of spirals from the junction of the upper end surface 112D of the inner cyclone 112 and the web 125 to the inner surface of the sleeve 126, thereby completing the inlet scroll 124. Although a pair of spiral portions 127A are shown in FIG. 10, the inlet scroll 124 can be completed by any number of spiral portions 127A. What is important, is that the spiral portions 127A provide a tangential entry to the inner cyclone 112, as shown by arrows 127B, in order to be capable of setting up a swirling, cyclonic flow of air in the inner cyclone 112.

The liner cage 113 projects from the outer surface 112C of the inner cyclone 112 to the base 111A of the outer cyclone 111. Liner cage 113 is comprised of a frusto-conical member 113A that is mounted on the outer surface 112C of the inner cyclone 112, spaced above the cone opening 112B. As shown in FIG. 14, a plurality of finger members 113B depends from the frusto conical member 113A to feet members 113C mounted on the base 111A of the outer cyclone 111. The finger members 113B and feet 113C, help to hold the liner section 132A on the base 111A of the outer cyclone 111. A right angled, cross-sectional member 113D is mounted on the outside of the frusto-conical member 113D and provides for mounting an annular seal member 128.

A combined shroud and disc unit 129 is mounted between the sidewall 112A of the inner cyclone 112 and the outer cyclone 111 and completes the vacuum cleaning apparatus 10. The unit 129 is comprised of a cylindrical section 129A that depends from sleeve 126 of the inlet scroll 124. Cylindrical section 129A has a plurality of openings 129B that are in and around the circumference of the cylindrical section 129A. Depending from the cylindrical section 129A is a disc 129C which can be conically shaped with a large downwardly tapered portion 129D facing the base 111A of the outer cyclone 111. The disc 129C can have a downwardly inclined angle between about 97½° to 110° from the axis B—B or 7½° to 20° from a line perpendicular to the axis C—C. The disc 129C can also be perpendicular to the axis C—C (not shown).

The disposable liner 130 is an integral unit and is comprised of the dirt receiver portion 131 for the inner cyclone 112 and a container portion 132 covering the inside of the outer cyclone 111. The container portion 132 is a flexible, bag shaped member that is made of paper or a plastic material such as polyethylene. The container portion 132 has a bottom section 132A extending to a sidewall section 132B and covers the entire inside of the outer cyclone 111. That way, the container portion 132 collects larger dirt particles separated from the airflow by the inner cyclone 111. An upper section 132C of the container portion 132 extends up and over the rim 111I of the outer cyclone 111 and seals between the annular ledge 115I of cover 115 and the rim 111I of the outer cyclone 111. An opening 132D near the upper edge of the sidewall section 131B provides for the dirty air inlet passage 122. The opening 132D is provided with a flexible gasket (not shown) which seals around the inlet passage 122. The gasket is provided with a contact adhesive to provide the seal with the inlet passage 122. The opening 132D can also be provided with a semi-rigid fitting (not shown) that mounts over and seals to the dirty air inlet passage 122.

The dirt receiver portion 131 of the liner 130 is a rigid portion that collects smaller dirt particles separated from the airflow by the inner cyclone 112. The receiver 131 has a first cylindrical section 131A that extends from a foot portion 131B to a frusto-conical section 131C. Foot portion 131B is bonded to the container portion 132 to form the integral liner 130. The frusto-conical portion 131C extends upwardly and inwardly towards the axis C—C to a second cylindrical member 131D. Cylindrical member 131D is sealed to the inner cyclone 112 by a pair of annular protrusions 128A that extend from seal 128. The protrusions 128A have an upwardly taper so that the inner cyclone 112 can mount inside of and seal to the receiver portion 131. The cylindrical section 131A of the receiver 131 is sealed to the shroud and disc unit 129 by an annular seal 129E that extends from the cylindrical member 129A, adjacent to the disc 129C, to the cylindrical member 131A. Seal 129E has an upwardly extending taper so that the shroud and disc unit 129 can mount around and seal to the receiver portion 131 of liner 130. This completes the seal between the outer cyclone 111 and the receiver portion 131.

When the cleaning apparatus 110 is fully assembled, the bottom wall section 132A of the container portion 132 of the liner 130 is mounted between the finger members 113B and the feet 113C of the liner cage 113 and the base 111A of the outer cyclone 111. That way, the liner cage 113 helps to hold the container portion 132 of the liner 130 in the outer cyclone 111. Also, the distal end 132C of the container portion 132 of the liner 130 acts to seal the upper edge of rim 111I of the outer cyclone 111 and the ledge 115I of cover 115.

In operation of the preferred version of the tank type vacuum cleaning apparatus 110 as shown in FIG. 9, is powered by a power cord 133 connected to a flexible power cord boot 134 mounted on the cover 115. The power cord 133 provides power to the motor fan unit 114 in response to the on/off switch 125 mounted on the cover 115. A handle 136 extends from the outside wall 115A of the cover 115 and aids in moving the cleaning apparatus 110. A hand grip 137 is recessed in the outside wall 115A of the cover 115 and provides for carrying the cleaning apparatus 110. The hand grip 137 is biased by a spring (not shown). When the hand grip 137 is not being used, the hand grip 137 recesses into the cover 115 to assume the hemispherical contour of the cover 115.

When the power cord 133 is connected to an electrical power source and the switch 135 is turned to the "on" position, the motor fan unit 114 mounted under the cover 115, pulls an airflow into the dirty air inlet passage 120 and into dirty air passage 122, which sets up a swirling, cyclonic flow of air in the outer cyclone 111. The airflow cyclones down and around the sidewall section 132B of the container portion 132 of the liner 130 mounted on the outer cyclone 111 to deposit larger dirt particles in the container portion 132. The airflow then moves up the cylindrical member 131A of the receiver portion 131 of the liner 130 and over the disc 129C, through the openings 129B in the cylindrical section 129C before entering the inlet scroll 124 for the inner cyclone 112 through an opening 125A in the web 125. In the inner cyclone 112 the airflow cyclones down the inside wall 112A to the cone opening 112B to deposit finer dirt particles on the bottom section 132A of the container portion 132 of the line 131. The cleaned airflow then moves upward and exits the inner cyclone 112 through the exhaust conduit 116B depending from plate 116 where the airflow exhausts from the cleaning apparatus 110 through the cover 115 through the annular vent 115F. The motor driven fan unit 114 also pulls a cooling airflow into the cover 115 through the first vent 115D. Thus, cooling airflow circulates around the cover 115 to cool the motor driven fan unit 114 before exiting the cover 115 through the second vent 115E.

The liner 130 thus collects the dirt separated from the airflow by the outer cyclone 111 and the inner cyclone 112 so that when the cover 115 with the inner cyclone 112, liner cage 113, shroud and disc unit 129 and motor fan unit 114 are separated from the outer cyclone 111 by grasping the cover 115 with hand grip 115C and lifting upward away from the outer cyclone 111, the liner 130 can be removed from the outer cyclone 111 for disposing of the accumulated dirt. The liner 130 is then disposed of and a new liner 130 is mounted on the outer cyclone 111. The liner 130 can also be emptied and replaced in the outer cyclone 111. The cover 115 is then remounted on the outer cyclone 111 to reassemble the vacuum cleaning apparatus 110.

It is intended that the foregoing description be only illustrative of the present invention and that the present invention be limited only by the hereinafter appended claims.

I claim:

1. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

(a) a cover means providing a closure for an upper end of the container, wherein the cover means removeably supports the container for disposing of dirt separated from the airflow by the container; and (b) a liner means having a first, rigid portion providing the receiver and a second portion wherein the receiver portion has a first sidewall between opposed ends, one of which is open and sealed to the cyclone to provide for the dirt separated from the airflow by the cyclone to accumulate in the receiver portion and wherein the second portion of the liner means has opposed ends defining a second sidewall between the ends, the second sidewall mounted along and around the longitudinal axis, inside of the interior surface of the container so that the second portion of the liner means collects dirt separated from the airflow by the container and extends to an open end of the second portion sealed at the upper end of the container, wherein the container holding the second portion is removeable from the cover means and the receiver portion is removeable from the sealed relationship with the cyclone for disposing of accumulated dirt separated from the airflow by the container and the cyclone.

2. The cleaning apparatus of claim 1 wherein the liner means is disposable.

3. The cleaning apparatus of claim 1 wherein an opening is provided through the second portion of the liner means for mounting around the dirty air inlet.

4. The cleaning apparatus of claim 3 wherein the opening in the second portion which mounts around the dirty air inlet is provided with a contact adhesive which engages the inside surface of the container around the dirty air inlet.

5. The cleaning apparatus of claim 1 wherein the open end of the second portion is mounted between the upper end of the container and the cover means when the container is mounted to the cover means.

6. The cleaning apparatus of claim 1 wherein a lower end of the second portion, adjacent to the bottom of the container, forms a bottom for the receiver portion at an end opposite the open end of the receiver portion.

7. The cleaning apparatus of claim 1 wherein the cover means provides the clean air outlet from the cyclone and the dirty air inlet to the container.

8. The cleaning apparatus of claim 1 wherein the receiver portion is rigid and the second portion, mounted inside the interior surface of the container, is flexible and wherein the second portion is bonded to the receiver portion so that the liner means is unitary.

9. The cleaning apparatus of claim 1 wherein the receiver portion and the second portion mounted inside the interior surface of the container are rigid and wherein the second portion is bonded to the receiver portion so that the liner means is unitary.

10. The cleaning apparatus of claim 1 wherein the open end of the receiver portion is provided with a first seal portion which removeably mounts against a second seal portion provided on an outside wall of the cyclone to provide the seal between the receiver portion and the cyclone.

11. The cleaning apparatus of claim 10 wherein the cone opening extends into the receiver portion of the collection means of the liner means.

12. The cleaning apparatus of claim 1 wherein the second portion of the liner means is flexible and wherein projection means are provided on an outside wall of the cyclone, intermediate the open end of and inside the receiver and the cone opening and extending from the outside wall of the cyclone to the bottom of the container, wherein the projection means serve to hold the second portion of the liner means on the bottom of the container, spaced below the cone opening so that the second portion of the liner means is prevented from moving towards the cone opening to block the cone opening.

13. The cleaning apparatus of claim 12 wherein the projection means are finger means that extend in a cylindrical pattern around the longitudinal axis of the cyclone from the outside wall of the cyclone to the bottom of the container to hold the second portion of the liner means on the bottom of the container and to prevent the liner means from moving towards the cone opening to block the cone opening.

14. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

(a) a cover means providing a closure for an upper end of the container, wherein the cover means removeably supports the container for disposing of dirt separated from the airflow by the container; and (b) a rigid, collection means comprising a first portion providing the receiver and a second portion providing the container, wherein the receiver portion has a first sidewall between opposed ends, one of which is open and sealed to the cyclone to provide for the dirt separated from the airflow by the cyclone to accumulate in the receiver portion of the collection means and wherein the second portion has opposed ends defining a second sidewall between the ends, the second sidewall mounted along and around the longitudinal axis, so that the container portion extends to an upper end removeably mounted to the cover means which forms a closure for the upper end of the container portion so that the container portion is removeable from the cover means to open the upper end of the container portion and the open end of the receiver portion is removeable from the sealed relationship with the cyclone for disposing of accumulated dirt separated from the airflow by the container and the cyclone.

15. The cleaning apparatus of claim 14 wherein the container portion and the receiver portion of the collection means are unitary and are constructed of a rigid, plastic material having a thin wall which is transparent for visually indicating when accumulated dirt is to be disposed of from the cleaning apparatus by disposing of the container portion and the receiver portion of the collection means.

16. The cleaning apparatus of claim 14 wherein a lower end of the container portion, adjacent to the bottom of the container, forms a bottom for the receiver portion at an end opposite the open end of the receiver portion.

17. The cleaning apparatus of claim 14 with a base means and a support means extending from the base means to support the cover means, which cover means supports the cyclone and provides the closure for the upper end of the container portion of the collection means wherein the support means provides for movement of the cover means and the cyclone from a rest position relative to the base means so that the container portion is removeable from the cover means and so that the receiver portion is removeable from the sealed relationship with the cyclone for disposing of accumulated dirt separated from the airflow by the container and the cyclone.

18. The cleaning apparatus of claim 14 wherein the open end of the receiver portion is provided with a first seal portion which removeably mounts against a second seal portion provided on an outside wall of the cyclone.

19. The cleaning apparatus of claim 18 wherein the cone opening extends into the receiver portion of the collection means.

20. The cleaning apparatus of claim 14 wherein the means for generating an airflow is mounted on the cover so as to draw air through the outlet from the cyclone.

21. The cleaning apparatus of claim 14 wherein a perforated shroud is provided around the cyclone in the container adjacent to the air inlet to the cyclone and the container portion of the collection means.

22. The cleaning apparatus of claim 14 wherein the container portion and the receiver portion of the collection means are constructed of a plastic material.

23. The cleaning apparatus of claim 22 wherein the plastic material is transparent for visually indicating when accumulated dirt is to be disposed of from the container portion and the receiver portion of the collection means.

24. The cleaning apparatus of claim 14 wherein the cover means has an annular gasket adjacent to the upper end of the container portion of the collection means.

25. The cleaning apparatus of claim 14 wherein the base means is provided with wheel means and the support means is provided with a handle means for moving the cleaning apparatus over a surface to be cleaned.

26. The cleaning apparatus of claim 14 wherein the container portion and the receiver portion of the collection means are disposable.

27. The cleaning apparatus of claim 14 wherein the first sidewall of the receiver portion has a frusto-conical section extending from a cylindrical portion of the receiver portion, adjacent to the bottom formed by the container portion of the collection means, to the open and of the receiver portion, wherein the cone opening of the cyclone extends through the open end and into the receiver portion for collecting dirt separated from the airflow by the cyclone.

28. The cleaning apparatus of claim 14 wherein the receiver portion and the container portion of the collection means are an integral unit.

29. The cleaning apparatus of claim 14 wherein the cover means provides the clean air outlet from the cyclone and the dirty air inlet to the container.

30. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

(a) a base means for the cleaning apparatus;

(b) a support means extending from the base means and supporting a cover means which supports the cyclone inside of the container; and (c) a collection means comprising a first portion providing the receiver and a second portion providing the container, wherein the receiver portion has a first sidewall between opposed ends, one of which is open and sealed to the cyclone to provide for the dirt separated from the airflow by the cyclone to accumulate in the receiver portion of the collection means and wherein the container portion has opposed ends defining a second sidewall between the ends, the second sidewall mounted along and around the longitudinal axis, so that the container portion extends to an upper end removeably mounted to the cover means as a closure for the upper end of the container portion and wherein the bottom of the container portion is moveable relative to the base means so that the container portion is removeable from the cover means to open the upper end of the container portion and so that the receiver portion is removeable from the sealed relationship with the cyclone for disposing of accumulated dirt separated from the airflow by the container and the cyclone.

31. The cleaning apparatus of claim 30 wherein the base means is provided with wheel means and the support means is provided with a handle means for moving the cleaning apparatus over the surface to be cleaned.

32. The cleaning apparatus of claim 30 wherein the support means is provided with a releasable lever means and wherein when the lever means is actuated, the container portion is moveable relative to the base means so that the container portion is removeable from the cover means and the receiver portion is removeable from the cyclone for disposing of the accumulated dirt.

33. The cleaning apparatus of claim 30 wherein a lower end of the container portion, adjacent to the bottom of the container, forms a bottom for the receiver portion at an end opposite the open end of the receiver portion.

34. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

(a) a base means for the cleaning apparatus;

(b) a support means extending from the base means and supporting a cover means which supports the cyclone inside of the container and provides a closure for an upper end of the container; and (c) a liner means having a first, rigid portion providing the receiver and a second portion wherein the receiver portion has a first sidewall between opposed ends, one of which is open and sealed to the cyclone to provide for the dirt separated from the airflow by the cyclone to accumulate in the receiver portion and wherein the second portion of the liner means has opposed ends defining a second sidewall between the ends, the second sidewall mounted along and around the longitudinal axis, inside of the interior surface of the container so that the second portion of the liner means collects dirt separated from the airflow by the container and extends to an open end of the second portion sealed at the upper end of the container, wherein the container holding the second portion, is removeable from the cover means and the receiver portion is removeable from the sealed relationship with the cyclone for disposing of accumulated dirt separated from the airflow by the cyclone and the container.

35. The cleaning apparatus of claim 34 wherein the second portion of the liner means has an opening that provides for the dirty air inlet.

36. The cleaning apparatus of claim 34 wherein the base means is provided with wheel means and the support means is provided with a handle means for moving the cleaning apparatus over the surface to be cleaned.

37. The cleaning apparatus of claim 34 wherein the support means is provided with a releasable lever means which provides for movement of the container relative to the base means so that when the lever means is actuated, the container is removeable from the cover means with the second portion being removeable from the cover means and the receiver portion being removeable from the cyclone for disposing of the accumulated dirt.

38. The cleaning apparatus of claim 34 wherein a lower end of the second portion, adjacent to the bottom of the container, forms a bottom for the receiver portion at an end opposite the open end of the receiver portion.

39. The cleaning apparatus of claim 38 wherein a lower portion of the container has a shape corresponding to an upper portion of the base means so that while in a rest position, the container is supported by the upper portion of the base means.

40. The cleaning apparatus of claim 34 wherein the second portion of the liner means is flexible and wherein projection means are provided on an outside wall of the cyclone, intermediate the open end of and inside the receiver and the cone opening and extending from the outside wall of the cyclone to the bottom of the container, wherein the projection means serve to hold the second portion of the liner means on the bottom of the container, spaced below the cone opening so that the second portion of the liner means is prevented from moving towards the cone opening to block the cone opening.

41. A liner means for use in a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

the liner means to be mounted in the container and having a first, rigid portion providing the receiver and a second portion wherein the receiver portion has a first sidewall between opposed ends, one of which is open and in a sealed relationship with the cyclone to provide for the dirt separated from the airflow by the cyclone to accumulate in the receiver portion and wherein the second portion of the liner means has opposed ends defining a second sidewall mounted along and around the longitudinal axis, inside of the interior surface of the container, with an end of the second portion adjacent to the bottom of the container forming a bottom for the receiver portion, and wherein the second portion of the liner means collects dirt separated from the airflow by the container and extends to an open end of the second portion sealed at the upper end of the container, wherein the container holding the second portion, is removeable from the cover means and the receiver portion is removeable from the sealed relationship with the cyclone for disposing of accumulated dirt separated from the airflow by the cyclone and the container.

42. The liner means of claim 41 with an opening in the container portion to be positioned around the dirty air inlet to the container.

43. The liner means of claim 41 wherein the container, and the container portion and the receiver portion of the liner means are constructed of a transparent plastic material to visually indicate when the liner means is to be emptied of accumulated dirt.

44. The liner means of claim 41 wherein the open end of the receiver portion is provided with a first seal portion which removeably mounts against a second seal portion provided on an outside wall of the cyclone to provide the sealed relationship between the receiver portion and the cyclone.

45. The liner means of claim 44 wherein the cone opening extends into the receiver portion of the collection means of the liner means.

46. A collection means for use in a cleaning apparatus including a container comprising a bottom and a sidewall extending to and meeting the bottom, the sidewall having an interior surface, a dirty air inlet at an upper portion of the container spaced form the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

the collection means comprising a first portion providing the receiver and a second portion providing the container, wherein the receiver portion has a first sidewall between opposed ends, one of which is open and sealed to the cyclone to provide for the dirt separated from the airflow by the cyclone to accumulate in the receiver portion of the collection means and wherein the container portion has opposed ends defining a second sidewall between the ends, the second sidewall mounted along and around the longitudinal axis, with an end of the container portion forming a bottom for the receiver portion at an end opposite the open end of the receiver portion wherein the container portion extends to an upper end which is removeably mounted to the cover means to form a closure for the container portion so that the container portion is removeable from the cover means to open the upper end of the container portion and the open end of the receiver portion is removeable from the sealed relationship with the cyclone for disposing of accumulated dirt separated from the airflow by the container and the cyclone.

47. The collection means of claim 46 wherein the container portion and the receiver portion are constructed of a transparent plastic material to visually indicate when the collection means is to be emptied of accumulated dirt.

48. The collection means of claim 46 as a disposable unit.

49. The collection means of claim 46 wherein the open end of the receiver portion is provided with a first seal portion which removeably mounts against a second seal portion provided on an outside wall of the cyclone to provide the sealed relationship between the receiver portion and the cyclone.

50. The collection means of claim 49 wherein the cone opening extends into the receiver portion of the collection means.

51. The collection means of claim 46 wherein the second portion of the liner means is flexible and wherein projection means are provided on an outside wall of the cyclone, intermediate the open end of and inside the receiver and the cone opening and extending from the outside wall of the cyclone to the bottom of the container, wherein the projection means serve to hold the second portion of the liner means on the bottom of the container, spaced below the cone opening so that the second portion of the liner means is prevented from moving towards the cone opening to block the cone opening.

52. In a cleaning apparatus including a container comprising a bottom and a sidewall extending to and meeting the bottom, the sidewall having an interior surface, a dirty air inlet at an upper portion of the container spaced from the bottom which is oriented for supplying dirt laden air into the container tangentially to the interior surface of the container which has a circular cross-section and an air outlet from the container at the upper portion of the container; a circular cross-sectioned cyclone having a longitudinal axis and mounted inside the container, the cyclone comprising a cyclone air inlet at an upper end having a first diameter of the cyclone in air communication with the air outlet of the container, an interior dirt rotational surface of frusto-conical shape for receiving an airflow from the air inlet and for maintaining its velocity to a cone opening smaller in diameter than the diameter of the upper end of the cyclone, the air inlet being oriented for supplying air tangentially to the surface and a cyclone air outlet communicating with the interior of the cyclone adjacent the upper end of the cyclone; a dirt collecting receiver means extending from the cone opening; and means for generating an airflow which passes through the dirty air inlet, the container, the cyclone air inlet, the cyclone, the receiver means and the cyclone air outlet, the airflow rotating around the frusto-conical interior surface of the cyclone and depositing the dirt in the receiver means, the improvement which comprises:

(a) a cover means supporting the cyclone and providing a closure for an upper end of the container, and with the receiver positioned between the container and the cyclone; and (b) a liner means having a first, rigid portion providing the receiver and a second portion mounted in the container wherein the receiver portion has a first sidewall between opposed ends, one of which is open and sealed to the cyclone to provide for the dirt separated from the airflow by the cyclone to accumulate in the receiver portion and wherein the container portion of the liner means has opposed ends defining a second sidewall between the ends, the second sidewall mounted along and around the longitudinal axis, inside of the interior surface of the container with a first end of the container portion providing a closure for an opposed end of the receiver portion adjacent to the bottom of the container, and wherein a second, open end of the container portion lays over the upper end of the container so that when the cyclone is positioned inside of the container, the section of the container portion of the liner means laying over the upper end of the container is provided between the container and the cover means to seal the upper end of the container, wherein the cover means and the cyclone secure the receiver portion and the container portion inside the container with the receiver portion collecting dirt separated from the airflow by the cyclone and with the container portion collecting dirt separated from the airflow by the container, wherein the cover means and the cyclone are removeable from the container so that the liner means can be moved out of the container for removing the collected dirt from the vacuum cleaning apparatus.

53. The apparatus of claim 52 wherein the container portion and the receiver portion of the liner means are formed as an integral unit.

54. The apparatus of claim 52 wherein the container portion and the receiver portion of the liner means are formed of a plastic material.

55. The apparatus of claim 52 wherein the container portion is provided with an opening adjacent to the container sidewall that provides for the dirty air inlet to the container.

56. The apparatus of claim 52 wherein the dirty air inlet opening in the container portion of the liner means is circular.

57. The apparatus of claim 52 wherein the second portion of the liner means is flexible and wherein projection means are provided on an outside wall of the cyclone, intermediate the open end of and inside the receiver and the cone opening and extending from the outside wall of the cyclone to the bottom of the container, wherein the projection means serve to hold the second portion of the liner means on the bottom of the container, spaced below the cone opening so that the second portion of the liner means is prevented from moving towards the cone opening to block the cone opening.

* * * * *

UNITED STATES PATENT AND TRADEMARK OFFICE

CERTIFICATE OF CORRECTION

PATENT NO. : 5,145,499

DATED : September 8, 1992

INVENTOR(S) : James Dyson

It is certified that error appears in the above-indentified patent and that said Letters Patent is hereby corrected as shown below:

Title Page under "U.S. Patent Documents", line 2, "4,573,323" should be --4,573,236--.

Column 7, line 30, "form" should be --from--.

Column 8, line 23, "form" should be --from--.

Column 8, line 44, "form" should be --from--.

Column 8, line 62, "he" should be --the--.

Column 9, line 4, "he" should be --the--.

Column 9, line 9, "form" should be --from--.

Column 9, line 21, "cay" should be --can--.

Column 9, line 66, "form" should be --from--.

Column 10, line 24, "he" should be --the--.

Column 10, line 42, "receives" should be --receiver--.

UNITED STATES PATENT AND TRADEMARK OFFICE

CERTIFICATE OF CORRECTION

PATENT NO. : 5,145, 499

DATED : September 8, 1992

INVENTOR(S) : James Dyson

It is certified that error appears in the above-indentified patent and that said Letters Patent is hereby corrected as shown below:

Column 10, line 48, "deposited" should be --disposed--.

Column 11, line 17, "the" should be --The--.

Column 11, line 36, "form" should be --from--.

Column 11, line 44, "form" should be --from--.

Column 11, line 46, "form" should be --from--.

Column 11, line 68, "19" should be --29--.

Column 12, line 4, "portion" should be --portions--.

Column 12, line 10, "an" should be --any--.

Column 12, line 28, "form" should be --from--.

Column 12, line 33, "form" should be --from--.

Column 12, line 38, "form" should be --from--.

Column 12, line 57, "form" should be --from--.

Column 17, line 14, "volumn" should be --volume--.

UNITED STATES PATENT AND TRADEMARK OFFICE

CERTIFICATE OF CORRECTION

PATENT NO. : 5,145,499

DATED : September 8, 1992

INVENTOR(S) : James Dyson

It is certified that error appears in the above-indentified patent and that said Letters Patent is hereby corrected as shown below:

Column 17, lines 24 and 25, "deposited" should be --disposed--.

Column 20, line 15, delete "of" (first occurrence).

Column 20, line 16, delete "FIG 9" and insert --FIG 11--.

Column 24, line 39 (Claim 27), "and" should be --end--.

Column 28, line 10 (Claim 46), "form" should be --from--.

Column 28, line 63 (Claim 48), "as" should be --is--.

Signed and Sealed this

Nineteenth Day of October, 1993

*Attest:*

*Attesting Officer*

BRUCE LEHMAN

*Commissioner of Patents and Trademarks*